US007921954B2

(12) United States Patent
Johnson et al.

(10) Patent No.: US 7,921,954 B2
(45) Date of Patent: Apr. 12, 2011

(54) STABILIZED MOBILE UNIT OR WHEELCHAIR

(75) Inventors: Charles E. Johnson, Rogersville, TN (US); Phillip N. Brown, Rogersville, TN (US); Jim Penson, Rogersville, TN (US)

(73) Assignee: Life Changing Chair, LLC, Rogersville, TN (US)

( * ) Notice: Subject to any disclaimer, the term of this patent is extended or adjusted under 35 U.S.C. 154(b) by 6 days.

(21) Appl. No.: 12/435,906

(22) Filed: May 5, 2009

(65) Prior Publication Data

US 2010/0117328 A1 May 13, 2010

Related U.S. Application Data

(60) Provisional application No. 61/050,516, filed on May 5, 2008.

(51) Int. Cl.
*B62B 7/06* (2006.01)
*B60N 2/16* (2006.01)
*A61G 5/08* (2006.01)

(52) U.S. Cl. ..... 180/209; 180/907; 280/250.1; 280/304.1; 280/647

(58) Field of Classification Search ..... 180/209, 180/907, 908; 280/149.2, 250.1, 304.1, 642, 280/647, 650, 657
See application file for complete search history.

(56) References Cited

U.S. PATENT DOCUMENTS 3,882,949 A 5/1975 Anderson
4,079,990 A 3/1978 McMunn et al.
4,613,151 A 9/1986 Kielczewski
5,011,175 A 4/1991 Nicholson et al.
5,259,664 A 11/1993 Cottle (Continued)

OTHER PUBLICATIONS

U.S. Appl. No. 11/835,963; Charles E. Johnson; "*Stabilized Mobile Unit or Wheelchair*"; filed Aug. 8, 2007.

(Continued)

*Primary Examiner* — Tony H. Winner
*Assistant Examiner* — Joseph Rocca
(74) *Attorney, Agent, or Firm* — Kilyk & Bowersox, P.L.L.C.

(57) ABSTRACT

The present invention relates to a mobile vehicle or wheelchair having the ability to provide stabilized transport to at least one individual on a variety of surfaces, slopes and/or terrains. In one aspect, the invention provides adjustment features allowing the mobile vehicle or wheelchair to accommodate individuals of various sizes and shapes. For example, the invention comprises a seat and an adjustable footrest which can be lengthened or shortened to accommodate different size individuals, including children. In one embodiment the distance between the footrest and the seat can be increased or decreased to accommodate different leg lengths of different individuals. The mobile unit or wheelchair of the invention may travel across smooth and very rough surfaces, slopes of varying or different angles and various outdoor terrains (including grassy, rocky, sandy, muddy and/or hilly terrains). In one aspect of the invention, the height of any part of the unit or the overall height of the device may be adjusted preferably to raise or lower the center of gravity. For example, the height of the device may be lowered to provide more stable transportation. In another aspect, the device may be adjusted to increase or decrease the size of the footprint (or any part of the footprint) of the device. For example, the footprint of the device may be enlarged to provide more stable transportation. Preferably, both the height of the device (or any part of the device) and the size of the footprint (or any part of the footprint) may be adjusted preferably to provide more stability.

16 Claims, 22 Drawing Sheets

U.S. PATENT DOCUMENTS

| | | | | |
|---|---|---|---|---|
| 5,333,887 | A | 8/1994 | Luther | |
| 5,601,302 | A | 2/1997 | Beard et al. | |
| 5,730,236 | A | 3/1998 | Miller et al. | |
| 6,530,445 | B1 | 3/2003 | Flowers et al. | |
| 7,100,718 | B2 | 9/2006 | Bancroft | |
| 7,360,840 | B2 | 4/2008 | Barlow et al. | |
| 7,758,063 | B2 * | 7/2010 | Johnson et al. | 280/647 |
| 2005/0116440 | A1 | 6/2005 | Bernatsky et al. | |
| 2005/0206124 | A1 * | 9/2005 | Levi et al. | 280/304.1 |
| 2007/0018443 | A1 * | 1/2007 | Wilmot | 280/755 |
| 2008/0129006 | A1 * | 6/2008 | Johnson et al. | 280/149.2 |

OTHER PUBLICATIONS

International Search Report for Application No. PCT/US09/02757, United States Patent Office, mailed Jun. 30, 2009, 1 page.

Notification Concerning Transmittal of International Preliminary Examination Report mailed Nov. 18, 2010, in PCT/US2009/002757.

International Preliminary Examination Report issued Nov. 9, 2010, in PCT/US2009/002757.

Written Opinion of the International Searching Authority (transmitted with Notification mailed Nov. 18, 2010), in PCT/US2009/02757.

* cited by examiner

STABILIZED MOBILE UNIT OR WHEELCHAIR

CROSS REFERENCE TO RELATED APPLICATIONS

This application claims the benefit of U.S. application Ser. No. 61/050,516, filed on May 5, 2008, which is hereby incorporated by reference in its entirety.

BACKGROUND OF THE INVENTION

1. Field of the Invention

The present invention is directed to a mobile vehicle or wheelchair having the ability to provide stabilized transport to at least one individual on a variety of surfaces, slopes and/or terrains.

2. Background Art

Wheelchairs have proven to be the most practical solution to mobility for individuals that have problems walking, due to age, sickness, and/or disabilities. While both conventional and motorized wheelchairs provide improved mobility to such individuals, current designs fail to adequately address the need of the individual to have broad access to various locations. In particular, current designs pose hazards to the occupant when operated on sloped and/or uneven surfaces. Current designs also fail to address various medical issues for certain individuals including poor circulation. Moreover, little has been done to provide an affordable design allowing broader availability.

The present invention addresses these and other needs.

BRIEF SUMMARY OF THE INVENTION

The present invention relates in general to a mobile unit, a vehicle, a mobile device and/or wheelchair which provides stabilized transportation for one or more passengers. In one aspect, the invention provides at least one adjustment feature allowing it to be modified to accommodate passengers of different sizes, including children. In another aspect of the invention, the height of any part of the unit or the overall height of the device may be adjusted preferably to raise or lower the center of gravity, and in a preferred aspect, the height of the device is lowered to provide more stable transportation for the user of the invention. In yet another aspect, the device may be adjusted to lengthen or shorten the base of the device, and in a preferred aspect, the base of the device is lengthened to provide more stable transportation for the user of the invention. Preferably, both the height of the device (or any part of the device) and the length of the base (or any part of the footprint) may be adjusted to provide more stability. More preferably, the unit of the invention comprises features allowing adjustment of the height of the device, the footprint the device and/or the passenger size of the device, in various combinations. In accordance with the invention, the various adjustment features can be engaged and/or operated independently or in various combinations.

In one embodiment, the unit may be adjusted to accommodate different height individuals. In a preferred aspect, the unit allows adjustment to accommodate different leg lengths. Such a unit of the invention may comprise a seat member and a footrest wherein the distance between the seat member and footrest can be changed. In one aspect, the device of the invention comprises a plurality of wheels, a base or main frame and a seat member comprising a footrest, wherein the distance between the footrest and the seat is adjustable. In another aspect, the unit of the invention comprises a plurality of wheels, a base or main frame and a seat member comprising a footrest (i) wherein the distance between the footrest and the seat can be increased or decreased, and (ii) wherein one or both of the following are included: (a) said base or main frame is adjustable such that the size of the footprint of the base or main frame may be increased or decreased, and/or (b) the seat member is adjustable such that the height of a seat member may be increased or decreased.

In one embodiment, the wheelbase of the wheelchair extends or retracts to vary the size of the footprint, while the height of the seat member of the wheelchair increases or decreases, which varies the location of the center of gravity.

In another embodiment, the base of the wheelchair extends or retracts to vary the size of the footprint, while the height of the seat member of the wheelchair increases or decreases, which varies the location of the center of gravity. The location of the center of gravity as well as the size of the footprint may contribute to the stability of the wheelchair, and through their adjustment the stability can be increased or decreased. In one aspect, while the height of the seat member pivots to a decreased height, leg rests pivot and extend from the main frame to support a user's legs throughout transition. In a preferred aspect, the leg rests can be extended or retracted to lengthen or shorten them.

In another embodiment, the seat member is adjustable between an upright and a lowered position, while the base is adjustable between a compacted and an extended position. In one aspect, when the seat member is in an upright position, and the base is in a compacted position, the wheelchair is suited to support a user sitting upright, legs bent at the knee. This position is conducive to indoor use, as the smaller footprint of the device and higher seat member in this configuration makes it easy to maneuver in an indoor environment, among other benefits. When the seat member is in a lowered position, and the base is in an extended position, the wheelchair is suited to support a user sitting in a reclined straight-leg (or substantially straight-leg) seated position. This position is conducive to outdoor use, as the lengthened wheelbase, larger footprint and lowered seat member in this configuration provide for greater stability in traveling over potentially uneven terrain, among other benefits.

In one embodiment, the relative movement of the base (or one or more wheels as part of the base configuration) and the lowering of the seat allows the center of gravity of the user/unit combination to be lowered and thus provides more stability for the operation of the unit by the user. The combination of lowering the seat and increasing the size of the footprint allows the user to sit in a relatively flat position. Preferably the operation of the invention allows the legs of the user to be extended (preferably the legs being flat or substantially flat). This feature of the invention allows the user's legs to extend in such a manner as to provide comfort to the user and/or increase blood circulation in the user's legs. In addition, having the ability to adjust the length of the leg rests according to the invention allows the proper positioning of the footrest for each individual to support the feet of that individual and provide comfort without binding the legs.

The invention is particularly suited for use by handicapped individuals or any user who desires aid in moving from place to place. In a preferred aspect, the device of the invention comprises a base or platform (which may be prepared of any material such as metal, plastic, wood and the like or combinations thereof, and can be designed in various configurations such as a frame, a solid platform and the like or combinations thereof). In another aspect, the base or platform (or any part of the base or platform) may be adjusted to increase or decrease the size of the footprint of the base or platform. In a preferred embodiment, the footprint is increased in size to provide more stability to the unit. Preferably, the size of the footprint may be increased by extending one or more portions of the base or platform. Such one or more portions may be extended or retracted, for example, by utilizing extension/retraction tracks and/or extension/retraction rods and/or extenders that allow two or more parts of the base or platform to separate and move away from or toward each other in such a manner to allow the overall footprint size of the base to increase or decrease.

In yet another aspect, the base or platform comprises a plurality of wheels, wherein the wheels may be designed (including various shapes, sizes and/or tread configurations) to accommodate any terrain. Preferably, the invention utilizes any number of wheels including at least two, at least three, at least four, at least five, at least six, at least seven, at least eight or more wheels depending on the need. In another aspect, the size of the footprint of the base may be increased or decreased by extending or retracting one or more wheels which may be included as part of the base or platform configuration. For example, one or more wheels may be extended or retracted, for example, by utilizing one or more extension/retraction tracks and/or extension/retraction rods and/or extenders that allow at least one wheel to separate and move away from or toward the base or platform in such a manner to allow the overall footprint size of the base or platform to increase or decrease.

In another aspect, the invention may be powered or moved manually by an individual or user or may be motorized (such as by one or more electric and/or combustion motors or combinations thereof). In yet another aspect, any one or a number of the wheels of the device may be powered by such one or more motors and preferably the unit of the invention is a multi-wheel drive unit, wherein a number or all of the wheels of the unit are driven by one or more drive motors. Preferably, the device of the invention comprises four (4) wheels and preferably at least two of such wheels (and preferably all four) are capable of being driven by one or more motors. In another embodiment, one or more motors of the invention are utilized to raise and/or lower all or any part of the unit. In another aspect, one or more motors are utilized to increase and/or decrease the size of the footprint of the unit (or any part of the unit). In yet another aspect, one or more motors are utilized to extend or shorten the length of the leg rests. In another embodiment, the same or different motors may be used to operate all or any number of the functions of the unit, and in a preferred aspect one motor is utilized to move the device, to increase and/or decrease the size of the footprint (or any part of the footprint), to raise and/or lower all or any part of the unit and to lengthen or shorten the leg rests. In utilizing the unit of the invention, the different functions of the device may be operated separately or simultaneously depending on the need of the user. When one or more motors provide operation of any or all of the features of the unit, the unit may also comprise one or more control devices allowing the user to control and operate the different features of the invention. For example, one or more control panels may be used to move the unit, adjust the size of the footprint, adjust the center of gravity and/or adjust the leg rests.

The device of the invention preferably comprises at least one seat or chair unit, and in a preferred aspect, the seat or chair may be adjusted to provide more comfort and/or stability for the user. In a preferred aspect, the at least one chair or seat may be adjusted up or down relative to the base or platform. Preferably, the chair or seat is lowered to provide more stability. Lowering the chair or seat according to the invention also provides better access to ground level activities, while increasing the height of the chair or seat provides better access to off the ground activities, such as easy access to table tops and counters. In a preferred aspect of the invention, the chair or seat is lowered by moving it generally forward relative to the front of the unit or the front of the chair, preferably by pivoting the seat such that it is lowered as it moves forward. In a different aspect, the chair or seat is lowered by moving it generally back away from the front of the unit or relative to the front of the chair, preferably by pivoting the seat such that it is lowered as it moves back. In another aspect, the seat or chair is lowered by moving it down with little or no general movement forward or backward relative to the base of the unit.

Preferably, the device of the invention comprises at least one leg rest. The invention also provides an adjustment feature allowing the at least one leg rest to be lengthened or shortened. In a preferred embodiment, the leg rest length is adjusted while the footprint of the unit is adjusted. In one aspect, at least one leg rest is extended to the desired length while the device platform is enlarged. Adjustment of the length of such leg rest preferably is accomplished by gear mechanism, where the size of the gear will affect the length of the leg rest. According to the invention, the gear adjusting the length of the leg rest can be easily replaced with larger or smaller gears, allowing quick adjustment to the unit. According to one aspect of the invention, a smaller gear will extend the length of the leg rest further than a larger gear. In another aspect, the gear is driven by the adjustment of the footprint of the unit by allowing gear teeth on an extension arm of the platform to engage with the teeth of the gear to thereby drive movement of the leg rest. Preferably, at least one footrest is attached to the leg rest and thus movement of the leg rest allows adjustment of the distance of the footrest from the seat of the unit. Thus, according to the invention, the unit can easily be adjusted to comfortably accommodate different size individuals.

In one aspect, the device of the invention may comprise (a) a platform, (b) a seat, and (c) a leg rest, wherein a leg rest is operably linked to the platform such that the length adjustment of the leg rest is accomplished upon movement of such platform. Preferably, the leg rest is operably linked to the platform through a gear mechanism. More preferably, the leg rest is operably linked to at least one extension arm of the platform. In a preferred aspect, gear movement is accomplished through movement of such extension arm. In a more preferred aspect, the size of the gear which engages the extension arm of the platform affects the adjustment of the length of the leg rest, allowing the device of the invention to accommodate individuals having different leg lengths.

In another aspect, the device of the invention may comprise (a) a platform, (b) a seat, and (c) a leg rest, wherein a leg rest is operably linked to the platform such that movement of the leg rest from a substantially horizontal position to a substantially vertical position (or from a substantially vertical position to a substantially horizontal position) is accomplished upon movement of such platform. Preferably, the leg rest is operably linked to the platform through a gear mechanism. More preferably, the leg rest is operably linked to at least one extension arm of the platform. In a preferred aspect, gear movement is accomplished through movement of such extension arm.

In another embodiment of the invention, the wheelchair comprises a main frame, a seat assembly pivotally connected to the main frame, such that the height of said seat assembly may be increased or decreased, a seat assembly link, pivotally connected at a first end to the seat assembly and pivotally connected to the extension frame at a second end, and a footrest assembly. An extension mechanism is connected to the extension frame and the footrest assembly. A gearing mechanism is operably connected to the extension mechanism and the seat assembly link. Gearing mechanism is capable of causing the extension mechanism to extend the footrest assembly away from the extension frame when the seat assembly link moves from a substantially vertical arrangement to a substantially horizontal arrangement Also, the gearing mechanism is capable of causing the extension mechanism to retract the footrest assembly toward the extension frame when the seat assembly link moves from a substantially horizontal arrangement to a substantially vertical arrangement. This allows for customization of the wheelchair to the height of the user.

In a preferred embodiment of the invention, both the chair/seat adjustment and the footprint size adjustment may be operated simultaneously or separately. Preferably, the chair/seat is lowered and the size of the footprint is increased and this operation provides the unit with more stability during operation. In one aspect, the seat/chair is lowered by moving it forward relative to the base or relative to the front of the chair, and the front of the base (or one or more wheels of the base configuration) is extended. In another aspect, the seat/chair is lowered by moving it back relative to the base or relative to the front of the chair, and the back of the base (or one or more wheels of the base configuration) is extended. In a different aspect, the chair may be lowered backwards while the front of the base (or one or more wheels of the base configuration) is extended. In a related aspect, the chair may be lowered by moving it forward while the back of the base (or one or more wheels of the base configuration) is extended. As will be apparent, one or multiple parts of the base (or one or more wheels of the base) may be extended as the chair/seat is adjusted.

BRIEF DESCRIPTION OF THE DRAWINGS/FIGURES

The advantages and features of the present invention will become better understood with reference to the following more detailed description and claims taken in conjunction with the accompanying drawings, in which like elements are identified with like symbols, and in which:

Figure 33:
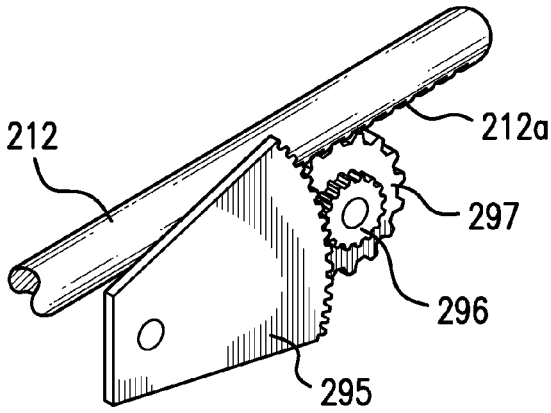

FIG. 33 is a partial schematic view of the relationship between various gears of the gearing arrangement. As shown in FIG. 33, small spur gear 296 can be attached to large spur gear 297. As is further shown in FIG. 33, large spur gear 297 can mesh with grooves 212*a* of extension mechanism 212 and segment gear 295 can mesh with small spur gear 296.

DETAILED DESCRIPTION OF THE INVENTION

The present invention relates in general to a wheelchair, a mobile unit, a vehicle, or another similar mobile device which provides stabilized transportation for one or more passengers. In one aspect of the invention, the height of the seat member may be adjusted preferably to raise or lower the user's position, and in a preferred aspect, the height of the seat member is lowered to provide more stable transportation for the user of the invention by lowering the center of gravity closer to the operating surface. In another aspect, the wheelchair, mobile unit, vehicle, or mobile device may be adjusted to increase or decrease the size of its footprint (or any part of the footprint), and in a preferred aspect, the footprint is enlarged to provide more stable transportation for the user of the invention. Both the height of the seat member and the size of the footprint (or any part of the footprint) may be adjusted to provide more stability.

Preferred embodiments of the present invention are now described. While specific configurations and arrangements are discussed, it should be understood that this is done for illustrative purposes only. A person skilled in the relevant art will recognize that other configurations and arrangements can be used without departing from the spirit and scope of the invention. It will also be apparent to a person skilled in the relevant art that this invention can be employed in a variety of other devices and applications. While specific examples described may refer to a wheelchair, the invention may equally apply to any mobile unit, vehicle, or any other mobile device.

As depicted in FIGS. 1-5, wheelchair 2 of the present invention is basically comprised of base assembly 15 (further comprising extension structure 8 and main frame 4), seat assembly 13, and leg support assembly 17.

Base assembly 15 provides the base structural support for wheelchair 2. Base assembly 15 is comprised of extension structure 8 and main frame 4. In operation, a user can control extension structure 8 to extend away from or move toward main frame 4, increasing or decreasing the size of the footprint of wheelchair 2. As the footprint increases, the stability of wheelchair 2 increases, as the footprint decreases, the maneuverability of wheelchair 2 increases. By varying the footprint, a user can achieve the optimum balance of maneuverability and stability for a given situation. The components of base assembly 15 may be prepared of any material such as metal, plastic, wood and the like or combinations thereof, and can be designed in various configurations such as a frame, a solid platform and the like or combinations thereof. Preferably, base assembly 15 is made of aluminum, or other suitable durable, lightweight metal, such as chrome molly.

Figure 6:
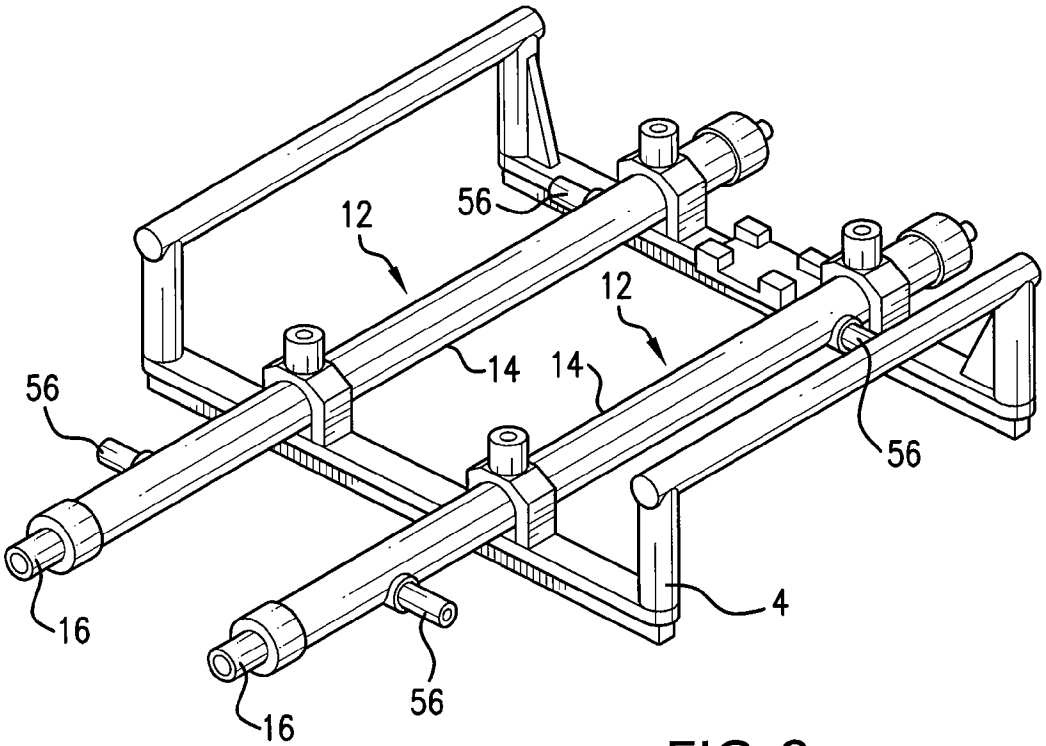
FIG. 6 is a pictorial view of one embodiment of the wheelchair or device of the invention showing the telescopic device operably secured to the main frame.
Figure 7:
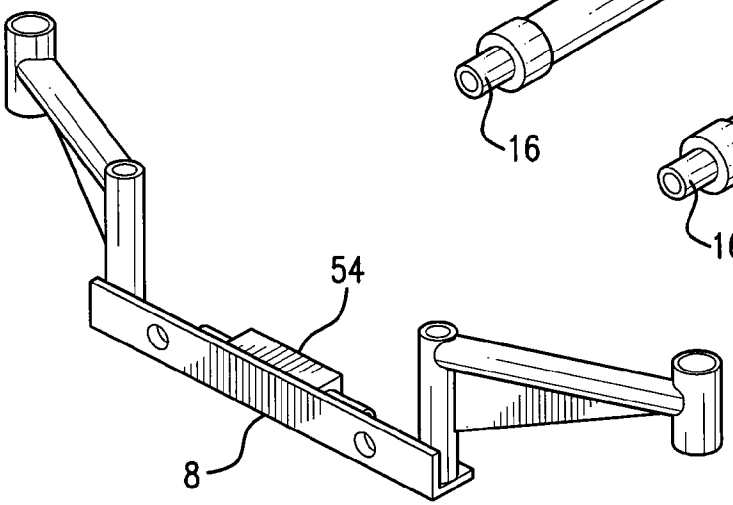
FIG. 7 is a pictorial view of one embodiment of the wheelchair or device of the invention showing the front portion of the base.

Extension structure 8 may be extended or retracted by utilizing telescopic devices 12, depicted in FIG. 6. Telescopic devices 12 allow part of the frame to extend or retract to increase or decrease the size of the footprint of the wheelchair or unit. Telescopic devices 12 may be extension/retraction tracks and/or extension/retraction rods and/or extenders that allow extension structure 8 to move away from or toward main frame 4 in such a manner to allow the overall footprint size of the base to increase or decrease. Extension structure 8 is secured operable to the main frame 4 by telescopic devices 12. Preferably extension structure 8 is made of the same or similar material as main frame 4. FIG. 7 shows the front portion of the base (which may comprise one or more wheels) and this portion of the base may be extended or retracted based on adjustment of the extension device or telescopic device. Adjusting the front portion of the wheelchair allows the footprint of the base to be increased when extended or decrease when retracted. Main frame 4 and extension structure 8 are supported by two rear wheel assemblies 9 and two front wheel assemblies 11, respectively. The substantially rectangular shape formed between the four wheel assemblies provides for a much more stable structure than would a triangular shape formed between three wheel assemblies. In yet another aspect, the base or platform comprises a plurality of wheel assemblies 9, 11 wherein wheel assemblies 9, 11 may be designed (including various shapes, sizes and/or tread configurations) to accommodate any terrain. In the embodiment shown in the figures, front wheel assemblies 11 and rear wheel assemblies 9 are utilized, but the invention may utilize any number of wheel assemblies, including at least two, at least three, at least four, at least five, at least six, at least seven, at least eight or more wheel assemblies, depending or the need. In another aspect, the size of the footprint of the base may be increased or decreased by extending or retracting one or more wheel assemblies 9, 11 which may be included as part of the base or platform configuration. For example, one or more wheel assemblies 9, 11 may be extended or retracted, for example, by utilizing one or more telescopic devices 12 that allow at least one wheel assembly 9, 11 to separate and move away from or toward the base or platform in such a manner to allow the overall footprint size of the base or platform to increase or decrease.

Figure 9:
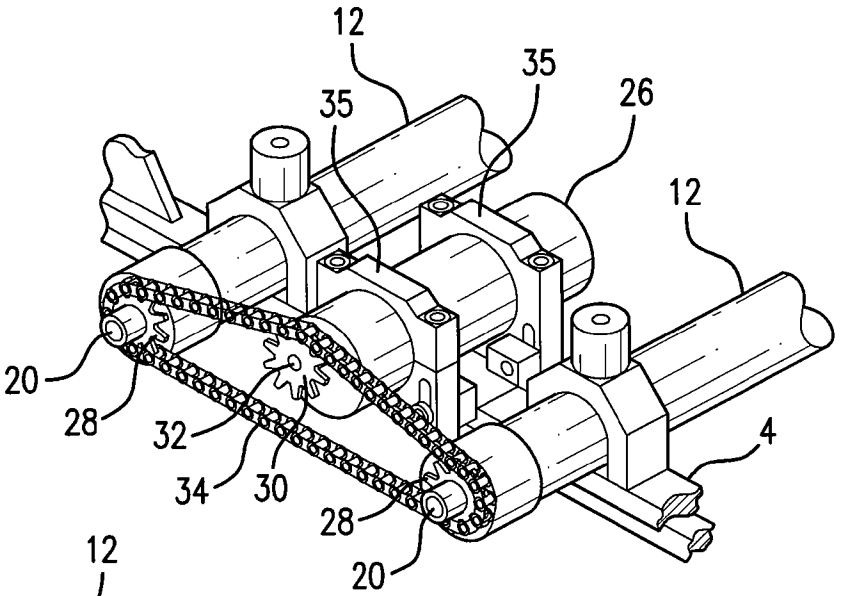
FIG. 9 is a partial section and rearward view of the telescopic device and the motor connected by a drive belt or chain for operation of the telescopic device.
Figure 8:
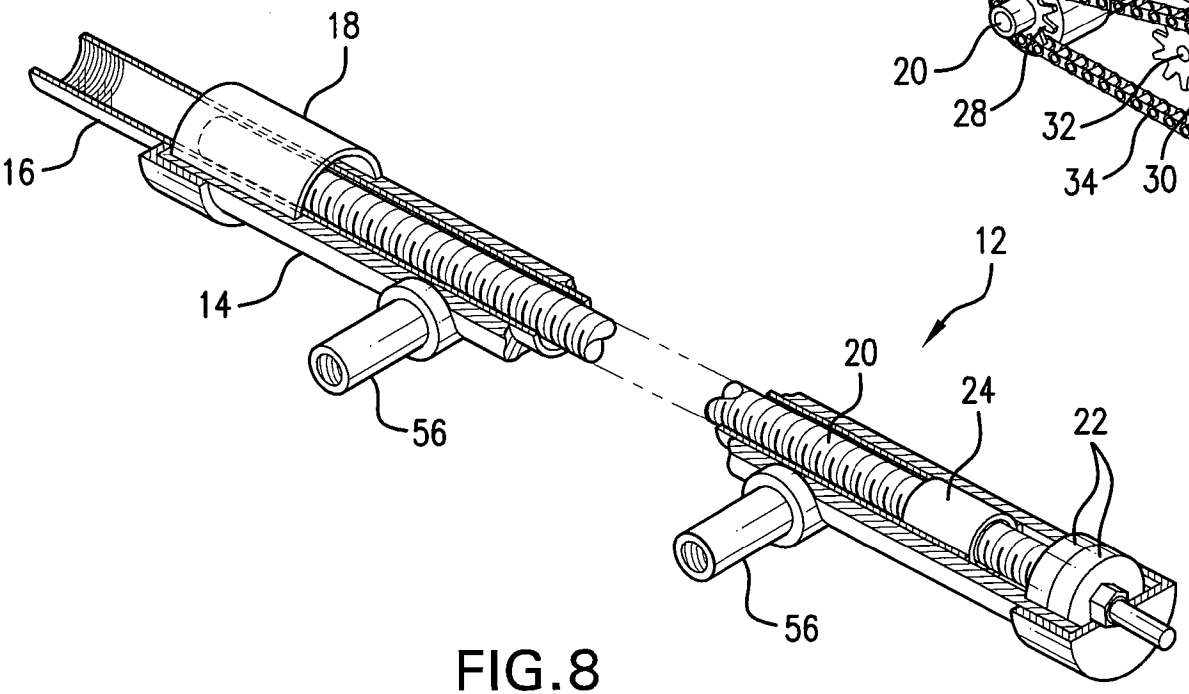
FIG. 8 is a partial section and view of a telescopic device of the device or wheelchair of the invention which when operated allows the footprint of the device or wheelchair to be increased (when extended) or decreased (when retracted).

Outer guide housings 14 of telescopic devices 12 are secured to main frame 8, and slide sections 16 of telescopic devices 12 are secured to extension structure 8. In addition to, or in place of telescopic devices 12, any other extending/retracting device or devices that are mechanical, electrical, pneumatic or hydraulic could be used, for example a screw cylinder, linear actuator, or total hydraulic system can be used to drive the extending/retracting device or devices. In one embodiment, depicted in FIGS. 6 and 8, slide section 16 moves through bearing(s) 18. Suitable bearings include a flanged or sleeve type journal bearing, a brushing, a fluid bearing, Rulon, Orlite, Frelon or other type linear bearings that give adequate support while substantially reducing sliding friction. Threaded shaft 20, similar to a jackscrew, is secured operable to outer guide housing 14 as by angular contact bearings 22 or other type thrust bearings. Female threaded member 24, which can be, for example, a nut, is secured to slide section 16 and adapted to move along threaded shaft 20 as that member rotates. A lubricant, such as grease, may be used on the threaded shaft to reduce friction. As shown in FIG. 9, motor 26, secured to main frame 4, transmits torque to gears 28 on threaded shafts 20 of telescopic devices 12 through gear 30 on motor shaft 32, via a belt, gear train, or chain 34. As threaded shaft 20 rotates, female threaded member 24 and slide section 16 move extension structure 8 away from or draw extension structure 8 to main frame 4. Adjustable motor brackets 35 achieve chain tension.

In another embodiment (not shown), motor 26 drives a worm gear, which in turn meshes with and drives the rotational motion of a pinion gear. The pinion gear in turn meshes with and drives the translational motion of a rack, as in a typical rack and pinion mechanism. The rack is secured to extension structure 8, and the translational motion of the rack moves extension structure 8 away from or draws extension structure 8 to main frame 4. Other mechanisms may also be used to translate power from motor 26 to telescopic devices 12.

In another embodiment, as discussed below with respect to FIGS. 18-21, the motion of extension structure 8 is controlled by a mechanism in which slide tubes controlled by a linear actuator replace the threaded shaft and female threaded member above. The slide tubes are connected at one end to main frame 4, and at the other end to extension structure 8. Activation of the linear actuator causes slide tubes to extend or retract, which moves extension structure 8 away from or toward main frame 4, respectively.

At least one seat may be attached to the seat member or seat support in such a manner that when operated, the seat is raised or lowered based on movement of the seat member or support. Components of seat assembly 13 connect to both extension structure 8 and main frame 4. Seat assembly 13 comprises at least one seat member 6, and in a preferred aspect, seat member 6 may be adjusted to provide more comfort and/or stability for the user. In a preferred aspect, seat member 6 may be adjusted up or down relative to the base or platform. Preferably, seat member 6 is lowered to provide more stability. Lowering seat member 6 according to the invention also provides better access to ground level activities and is more stable, which is useful for outdoor use, where the terrain may be more uneven and unpredictable, while increasing the height of seat member 6 provides better access to off the ground activities, such as easy access to table tops and counters and is more maneuverable, which is useful for indoor use, where turning tight corners and fitting through narrow doorways is a concern. In this manner, the single wheelchair can be used for a variety of activities, providing the user with a greater range of motion, and can operate both indoors and outdoors. In a preferred aspect of the invention, seat member 6 is lowered by moving it in the direction of the front of the unit or generally forward relative to the base or platform, preferably by pivoting seat member 6 such that it is lowered as it moves forward. In a different aspect, seat member 6 is lowered by moving it generally back relative to base or platform, preferably by pivoting seat member 6 such that it is lowered as it moves back. In another aspect, seat member 6 is lowered by moving it down with little or no general movement forward or backward relative to the base or platform.

Figure 10:
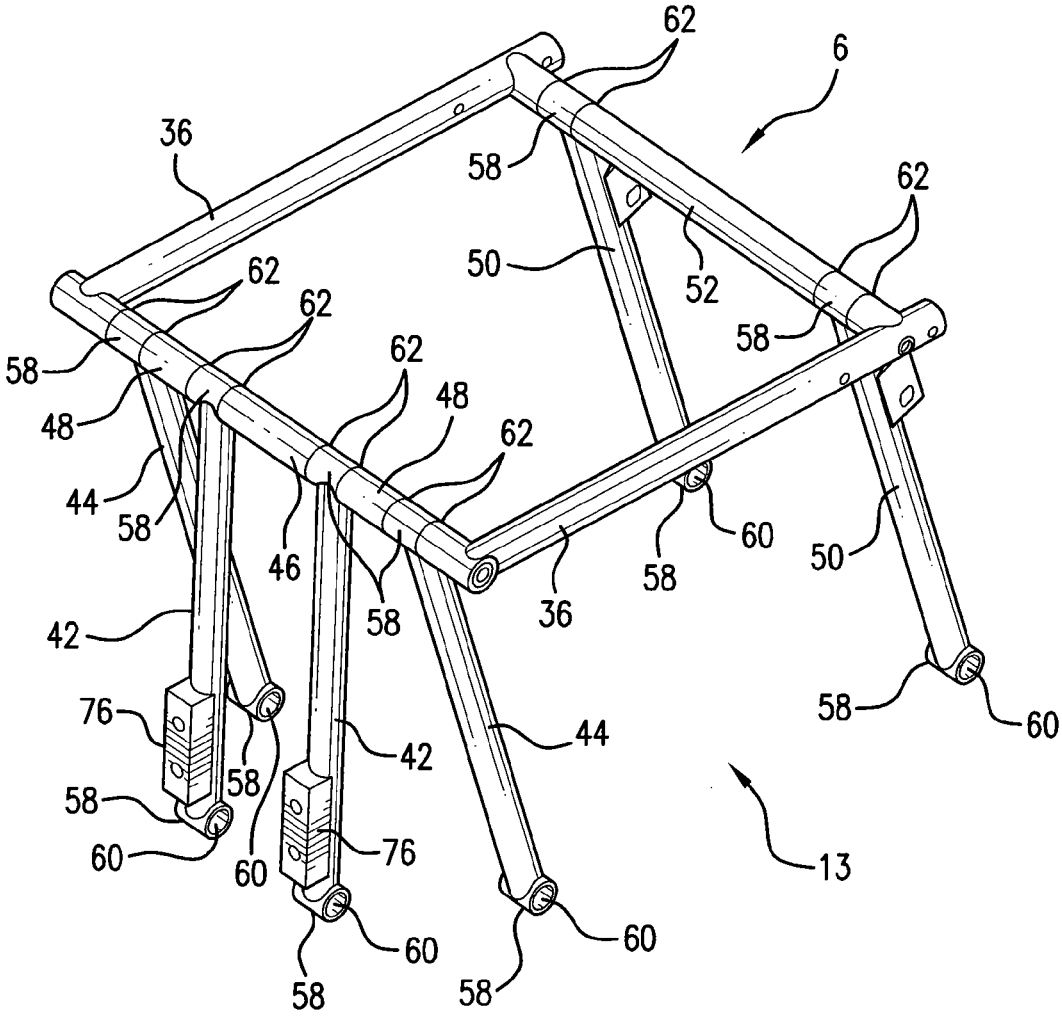
FIG. 10 is a pictorial view of the seat member or seat support which when operated pivots forward or backward to allow it to move up or down.
Figure 11:
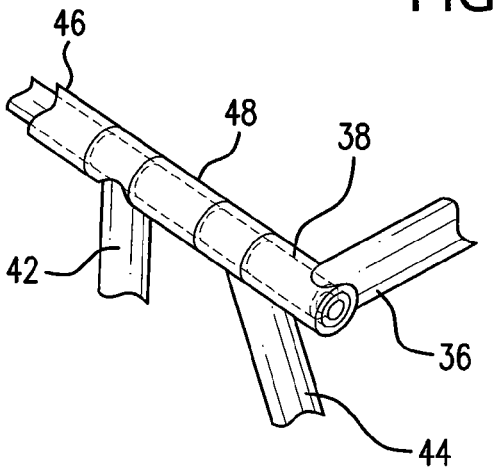
FIG. 11 is a partial section and view of the forward connection of the seat member or seat support showing various pivot points allowing movement of the support up or down.
Figure 12:
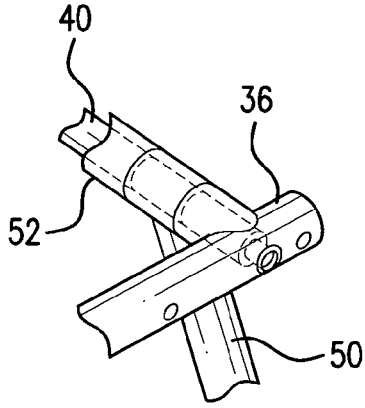
FIG. 12 is a partial section and view of the rearward connection of the seat member or seat support showing one pivot point allowing movement of the support up or down.

Seat assembly 13, depicted in FIG. 10, which in operation lowers or raises seat member 6 as described above, is a rigid, yet operable framework. Much of this framework is made up of preferably aluminum tube stock or other suitable durable, lightweight metal such as chrome molly, but can also be steel, fiber, wood, plastic, metal, any other material with suitable functional qualities, or any combination thereof. Seat member sides 36 are secured to and conjoined by axle rods 38 and 40, as shown in FIGS. 11 and 12. At least one seat member 6 may be attached to seat member sides 36. Seat member links 42 and 44 are pivotally secured to axle rod 38 and maintained in a uniform manner by spacers 46 and 48, depicted in FIG. 11. Seat member links 50 are pivotally secured to axle rod 40 and maintained in a uniform manner by spacer 52, depicted in FIG. 12. Seat member 6 is coupled to telescopic devices 12 and extension structure 8 by seat member links 42, 44 and 50, depicted in FIG. 13. Seat member links 44 and 50 are pivotally secured to outer housing guides 14 of telescopic devices 12 by four connecting pins 56, which can be pins, bolts, rivets, radial bearings, or any other suitable connection mechanism, best depicted in FIG. 6. Seat member links 42 are pivotally secured to a pin block 54 on extension structure 8, depicted in FIG. 7. Connecting pins 56 on outer housing guides 14 of telescopic devices 12 and pin block 54 on extension structure 8 are anodized to prevent wear. Pivotal connections 58 of seat member links 42, 44 and 50 contain brass bushings 60, or other type bushings or bearings, and bushings 62, made of an engineering plastic, such as that available from DuPont under the tradename DELRIN, or other type bushings or bearings are placed at the sides of pivotal connections 58 to prevent binding and galling when the seat is raised or lowered.

Figure 13:
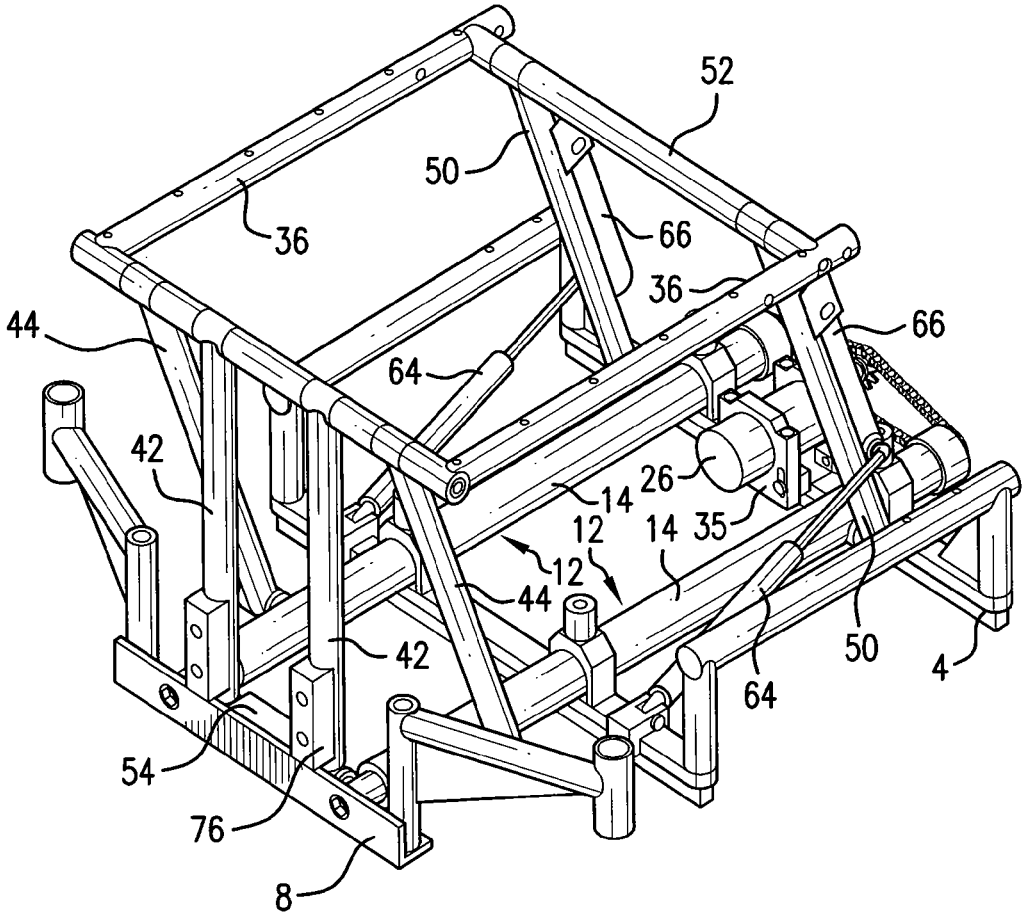
FIG. 13 is a pictorial view of one embodiment of the operating mechanism showing the motor, the extender(s) (or telescopic device), the seat support and the base adjuster.

Due in part to the formation of seat assembly 13 and the pivotal connections of seat assembly 13 to extension structure 8 and main frame 4 (through the pivotal connections on telescopic devices 12), as base assembly 15 operates to move extension structure 8 away from or toward main frame 4, this motion drives a transition in seat assembly 13 which causes seat member 6 to move forward and down or backward and up, while maintaining a horizontal surface. In this manner, the footprint size may increase or decrease simultaneously, or otherwise in synchronization, as seat member 6 raises and lowers. As shown in FIG. 13, by operation of the motor, the extenders may be extended or retracted and such extenders are operably linked to the seat support and the front of the base (the wheel configuration of the base). As the extenders are extended or lengthened, the seat support pivots in such a manner as to allow the seat support to move forward so that the support is lowered. The lengthening of the extenders also allows the base front (the wheel configuration of the base) to be extended thus increasing the footprint of the base. This operation will be explained in greater detail below.

Figure 14:
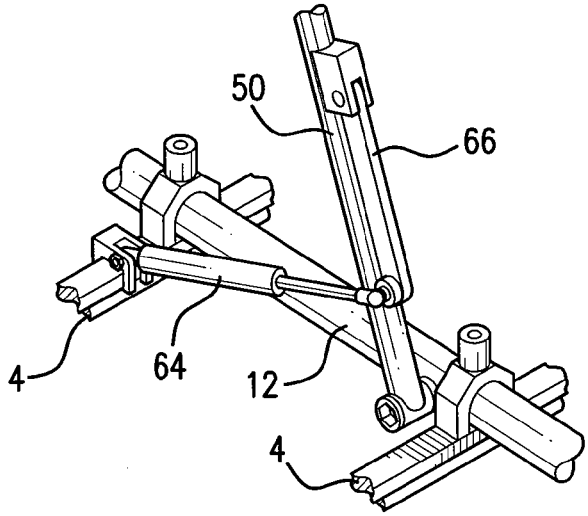
FIG. 14 is a partial section and rearward view of an optional lifting assist device connected to the main frame (or platform) and a seat member or seat support.

Due to an occupant's bodyweight, when seat member 6 is in a lower position, a large amount of torque is needed from motor 26, and deflection problems of seat member links 42, 44 and 50 may occur when lifting seat member 6. In FIG. 14, a gas spring cylinder 64 or cylinders is used to assist lifting. Gas spring cylinder 64 may also be a torsion spring. Gas spring cylinders 64 could also be a spring mechanism, a hydraulic mechanism, or any other suitable lifting mechanism. Gas spring cylinder 64 provides additional force to assist seat member links 50 (occupied or not occupied by a user) to move up, thus raising seat member 6. One or more gas spring cylinders 64 may be used according to the invention depending on the need. Gas spring cylinders 64 are pivotally secured to main frame 4 and to swing arms 66 pivotally secured to seat member links 50.

Figure 15:
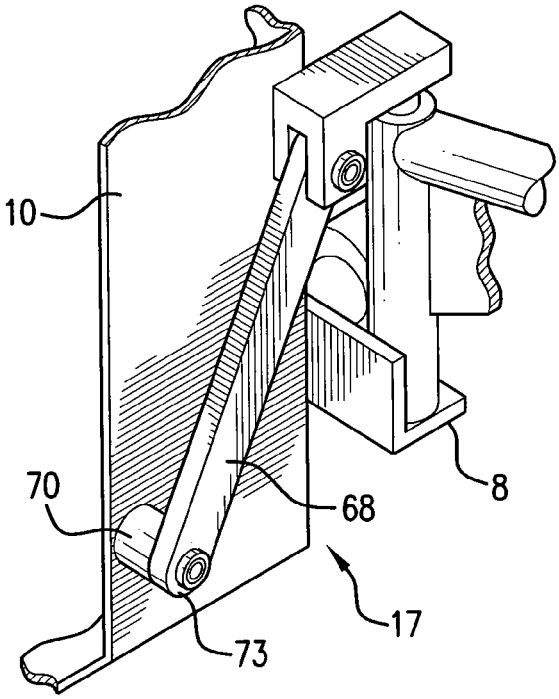
FIG. 15 is a partial section and view of the extension structure and footrest and leg rest pivotally connected by a swing arm support.
Figure 16:
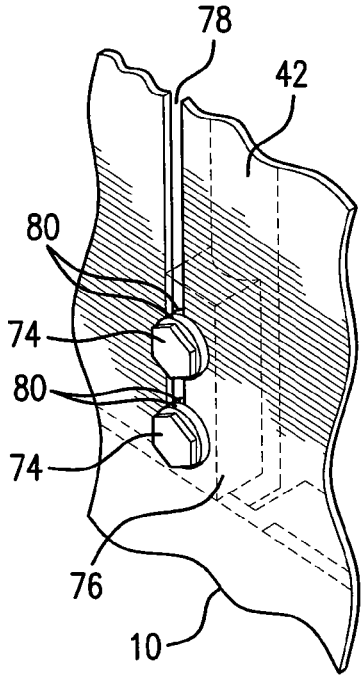
FIG. 16 is a partial section and view of the footrest/leg rest member connected to a seat member or seat support by a slide mount enabling the footrest/leg rest to be adjusted.

Depicted in FIG. 15, leg support assembly 17 is comprised of leg rest member 10, swing arms 68, spacers 70, and protection cover 82. Alternatively, leg rest member 10 can be a bent-tube type leg rest. Leg rest member 10 is pivotally secured to extension structure 8 by swing arms 68 and pins 74 connected to slide blocks 76. A spacer 70, made of an engineering plastic, such as that available from DuPont under the tradename DELRIN, is used on the sides of pivotal connections 72 of swing arms 68 to prevent seizing and galling. Pins 74, best depicted in FIG. 16, are securely attached to slide blocks 76 on seat member links 42 and travel through parallel slots 78 on leg rest member 10. Washers 80, made of an engineering plastic, such as that available from DuPont under the tradename DELRIN, are used on the front and rear of parallel slots 78 of footrest member 10 to prevent binding and galling. Protection cover 82 is secured to footrest member, depicted in FIG. 1, over parallel slots 78 and pins 74 on slide block 76, to prevent injury to the occupant's legs. As the front portion of the unit extends, the footrest/leg rest pivots preferably in a flat or horizontal position or substantially flat or substantially horizontal position. In addition to, or in place of swing arms 68 and slide blocks 76, any other extending/retracting device or devices that are mechanical, electrical, pneumatic or hydraulic could be used, for example a screw cylinder, linear actuator, or hydraulic system can be used to drive the extending/retracting and pivoting motions of leg rest member 10. In operation, which is discussed in greater detail below, leg support assembly 17 protects and guides a user's legs throughout motion of wheelchair 2, in such a way as to maintain comfort and facilitate independent operation by the user, without assistance from others.

In another embodiment, the position of leg rest member 10 is controlled by a linear actuator between seat 6 and leg rest member 10. A linear bearing and rod are attached to each of seat member links 42. In this embodiment, due to the force of the linear bearing and rod throughout the transition, leg rest member 10 extends and pivots to allow a user's legs to lay flat as seat 6 changes from an upper position to a lower position, and leg rest member retracts and pivots to allow a user's legs to bend at the knee as seat 6 changes from a lower position to an upper position. As shown in FIGS. 18-21, extension structure 8 extends from main frame 4 driven by linear actuator 19. Linear actuator 19 is pivotally connected at one end to seat member link 42, and pivotally connected at the opposite end to main frame 4. In this embodiment seat member link 42 is forced away from or toward main frame 4 by the linear motion of linear actuator 19. As seat member link 42 moves, it pivots at the point of connection with linear actuator 19, and in a fully extended state, seat member link 42 lays over linear actuator 19 to provide additional stability. Actuator support member 21 is attached to main frame 4, and is shaped to accommodate linear actuator 19 axially. When linear actuator 19 extends it pivots at the point of connection with main frame 4 and lays itself into the recess in actuator support member 21, providing additional support and stability for wheelchair 2. Extension support members 23 are attached to extension structure 8 at one end, and main frame 4 at the opposite end. During the extension/retraction of linear actuator 19, extension support members 23 extend or retract accordingly, in order to provide support on each side of wheelchair 2.

In one embodiment, the relative movement of the base (or one or more wheel assemblies 9, 11 as part of the base configuration) and the lowering of seat member 6 allows the center of gravity of the user/unit combination to be lowered and thus provides more stability for the operation of wheelchair 2 by the user. In one aspect, the combination of lowering the seat and increasing the size of the footprint allows the user to sit in a relatively flat position. Preferably the operation of the invention allows the legs of the user to be extended (preferably the legs being flat or substantially flat). Leg rest member 10 supports the legs and feet of the user throughout the transitions of wheelchair 2. Leg rest member 10 is shaped in such a way so as to retain and guide the legs of the user through the transitions, which is a key feature especially for an individual without internal control of his or her legs, such as a paralyzed individual. This feature of the invention allows the user's legs to extend in such a manner as to provide comfort to the user and/or increase blood circulation in the user's legs. It assists in transitioning the position of the user's body without requiring him or her to leave wheelchair 2.

Figure 1:
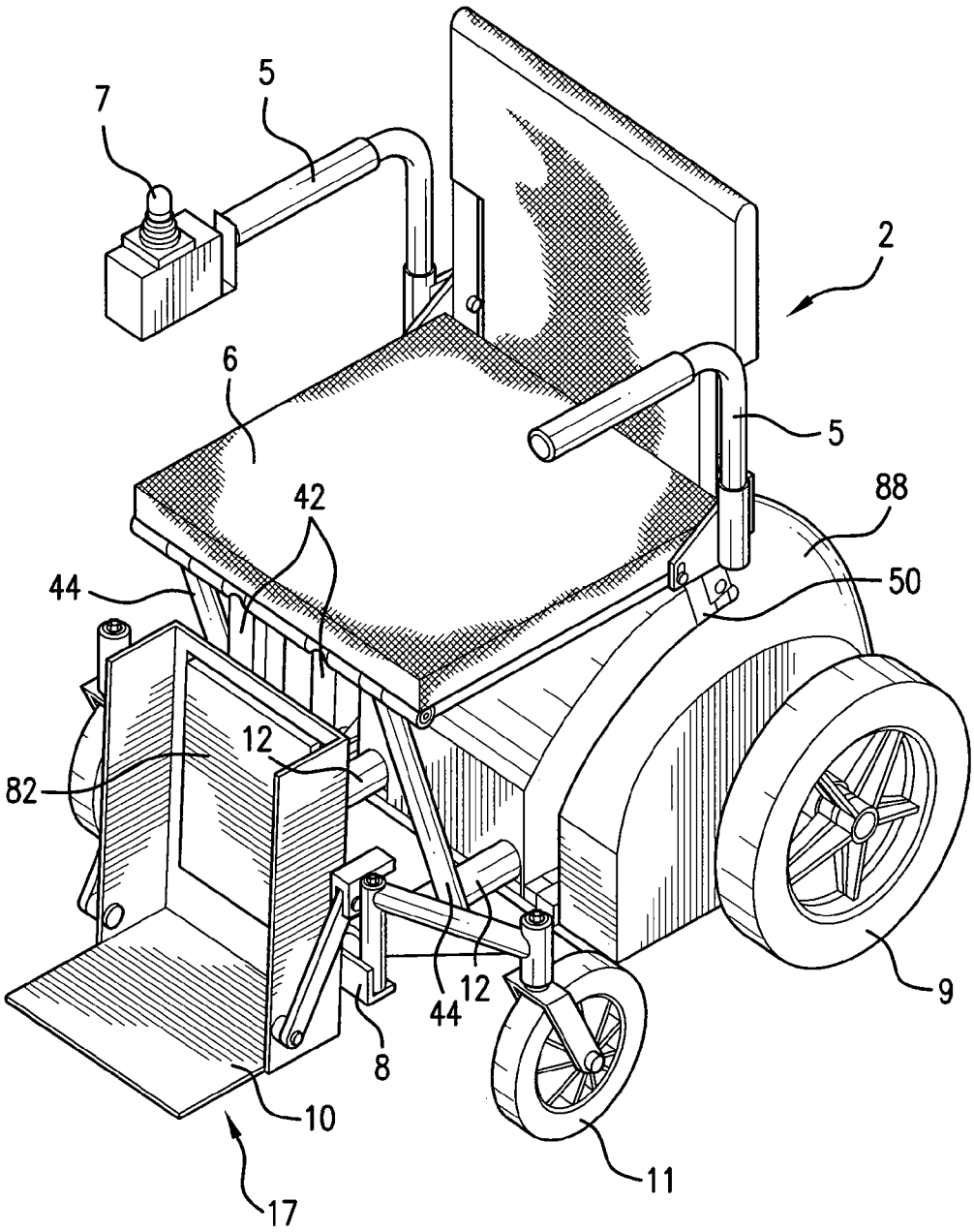
FIG. 1 is a pictorial view of one embodiment of the wheelchair or device of the invention in which the wheelchair is in the uppermost position, with the leg protection cover on the footrest member and the component cover on the main frame, both of which are removed on all other drawings to better show operation.
Figure 2:
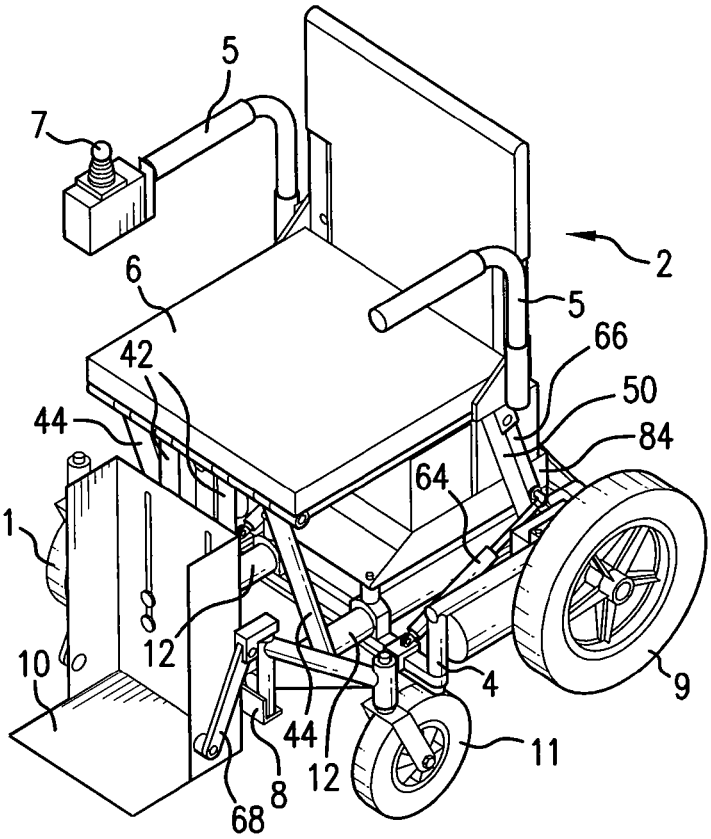
FIG. 2 is another pictorial view of one embodiment of the wheelchair or device of the invention in which the wheelchair is in the uppermost position.
Figure 17:
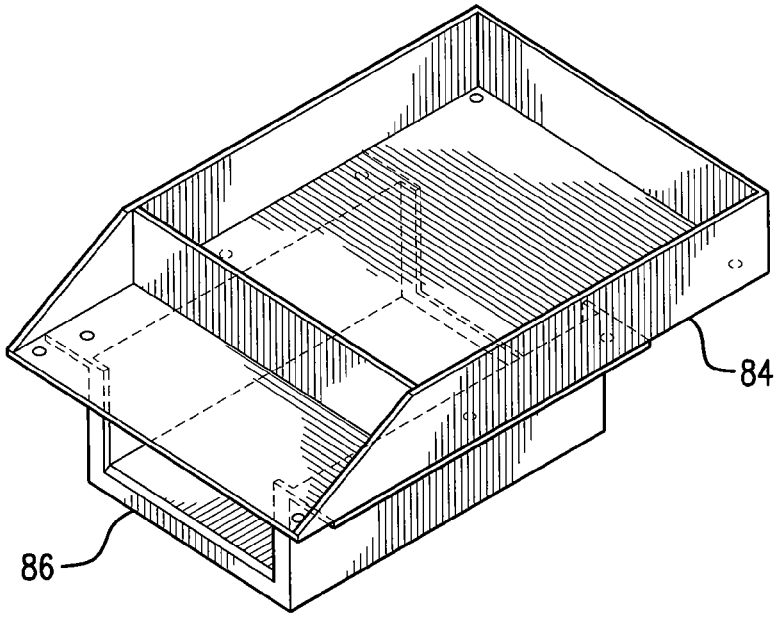
FIG. 17 is a pictorial view of the tray embodiment to contain various components for the unit or wheelchair of the invention, including one or more batteries and/or one or more circuit boards.
Figure 18:
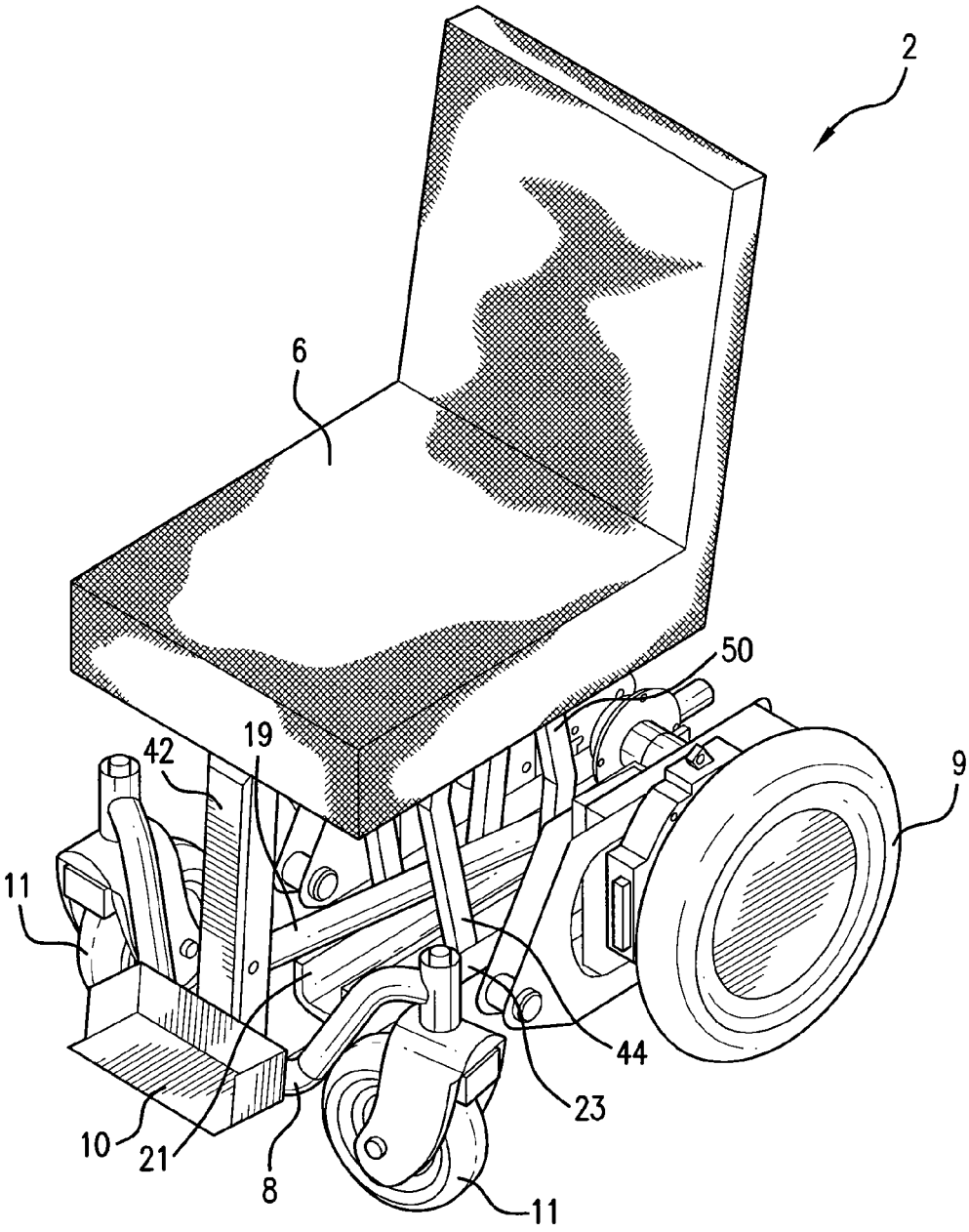
FIG. 18 is a pictorial view of another embodiment of the wheelchair in an upright position, in this embodiment a linear actuator is used to extend or retract the device.
Figure 19:
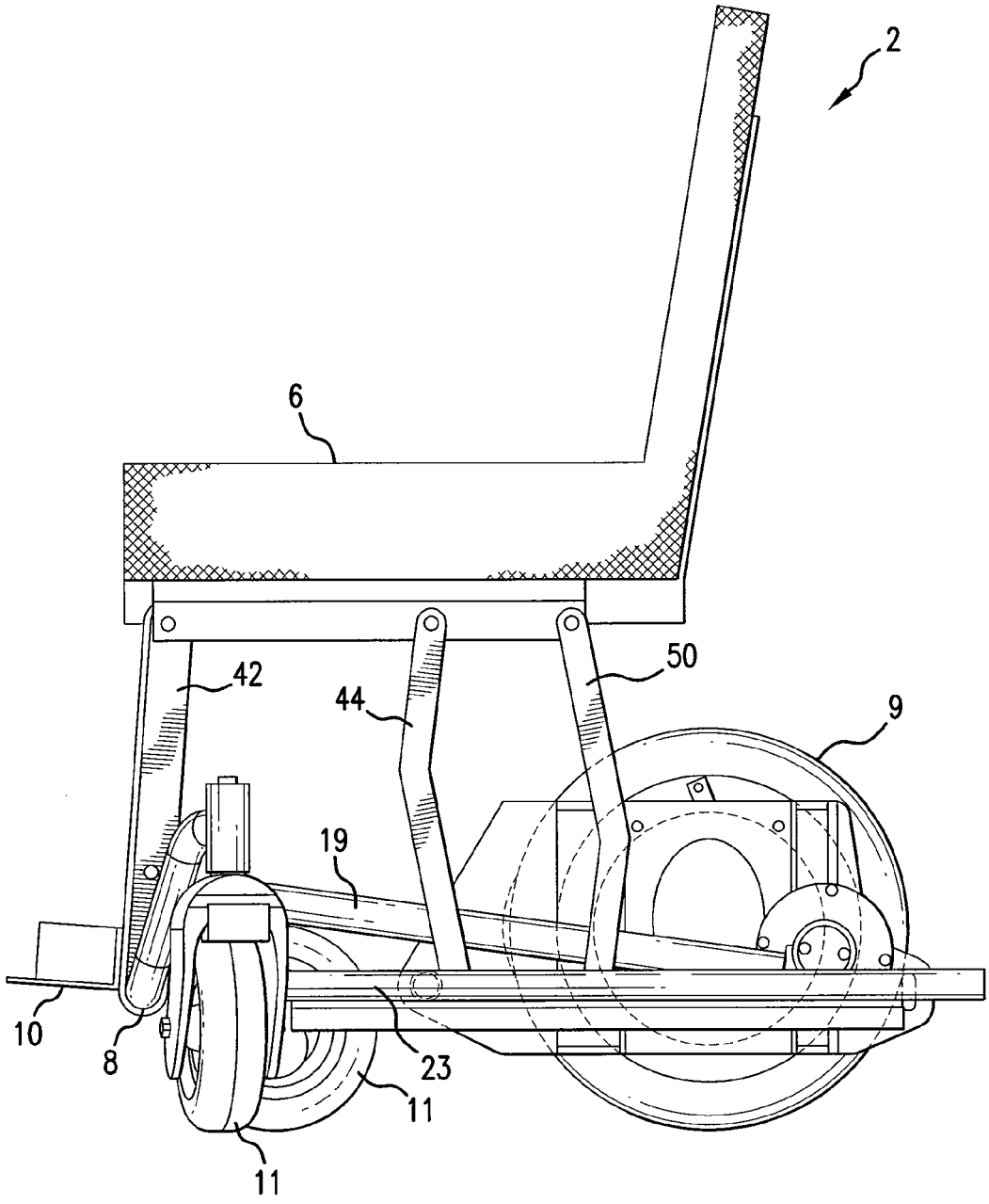
FIG. 19 is a side view of another embodiment of the wheelchair in an upright position, in this embodiment a linear actuator is used to extend or retract the device.
Figure 20:
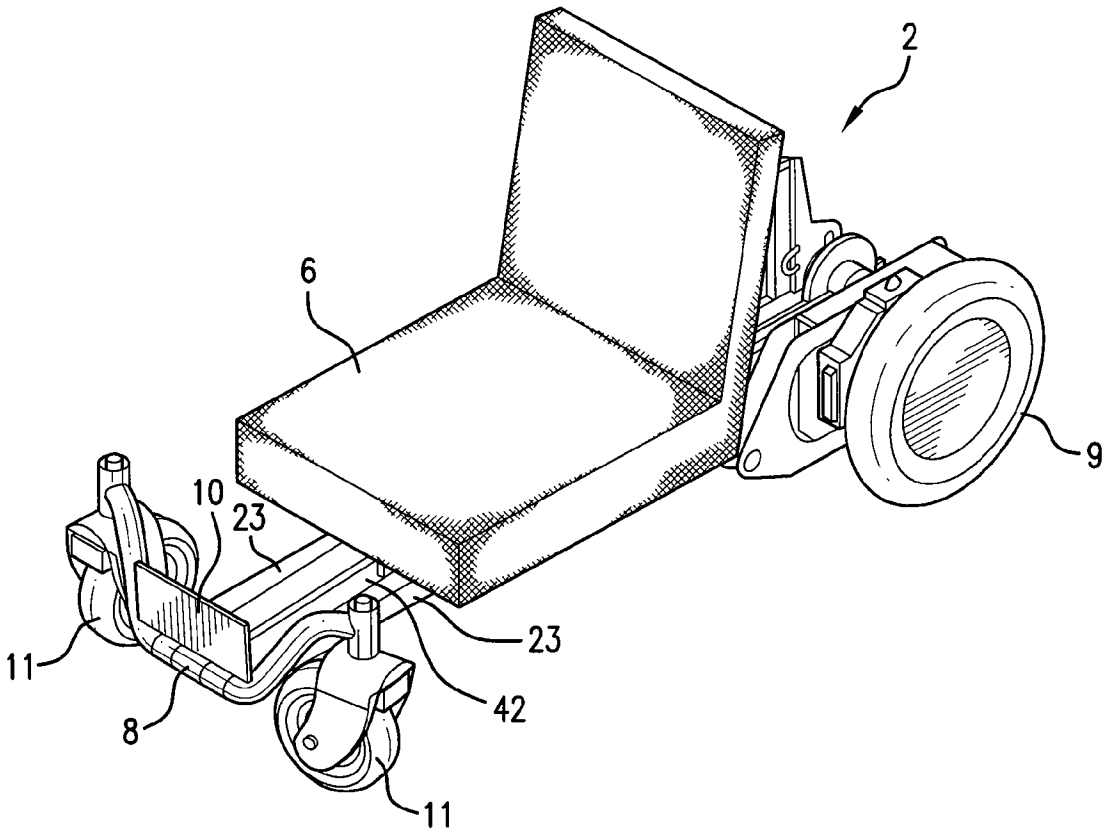
FIG. 20 is a pictorial view of another embodiment of the wheelchair in a lowered position, in this embodiment a linear actuator is used to extend or retract the device.
Figure 21:
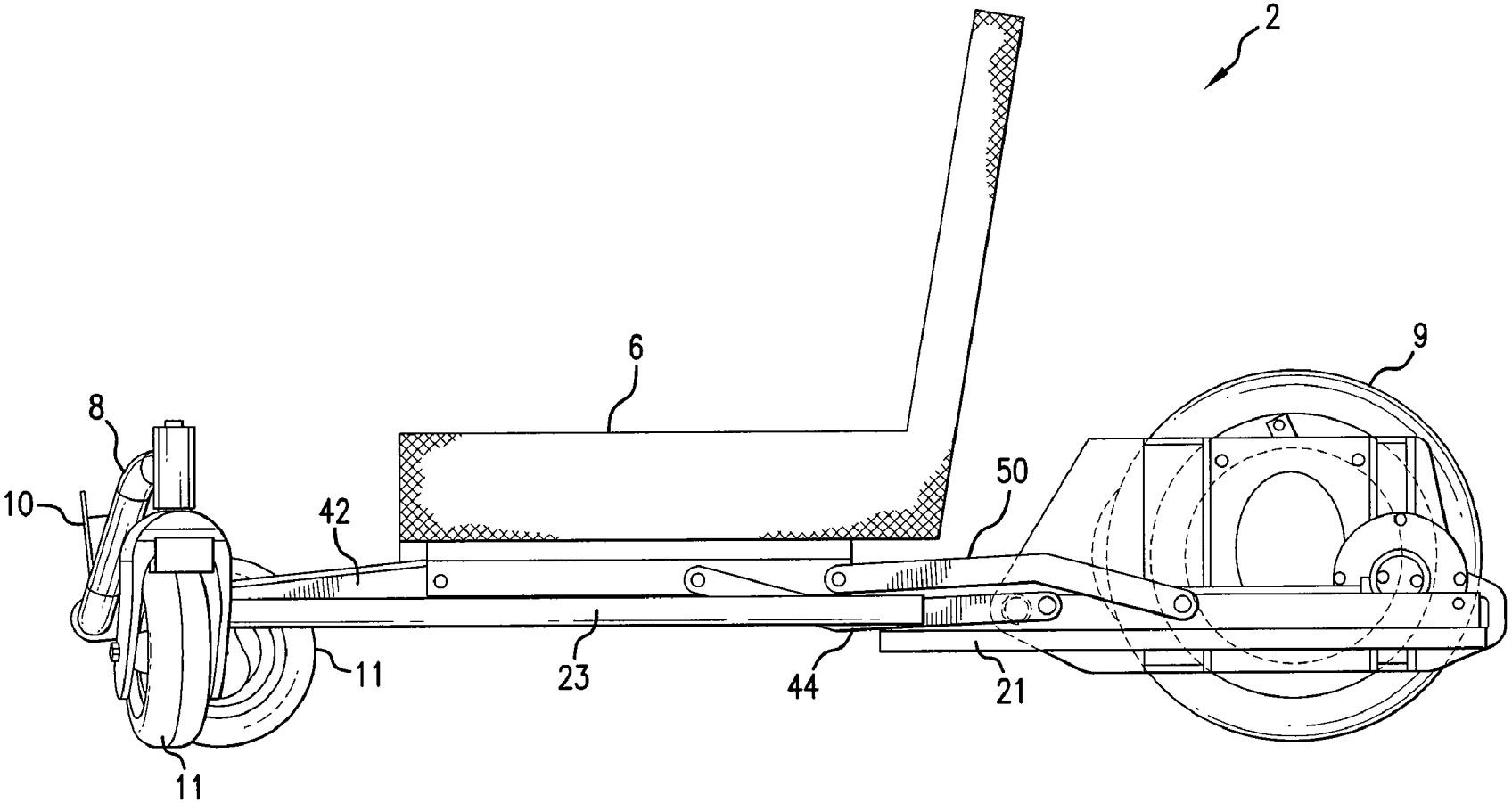
FIG. 21 is a side view of another embodiment of the wheelchair in a lowered position, in this embodiment a linear actuator is used to extend or retract the device.

Since electrical components are used in the present application, battery or batteries tray 84 and circuit board tray 86, depicted in FIG. 17 are secured to main frame 4. Batteries tray 84 and circuit board tray 86 may be removable for service and repair, and may be replaceable. In FIG. 1, cover 88 is secured to main frame 4 to protect the occupant from pinch points when seat is being raised or lowered and the electrical components from the environment.

In preferred embodiments of the invention, both the seat adjustment and the footprint size adjustment may be operated simultaneously or separately. Preferably, seat member 6 is lowered as the size of the footprint is increased and this operation provides the unit with more stability during operation. In one aspect, seat member 6 is lowered by moving it forward relative to the base, and the front of the base, extension structure 8, is extended. In another aspect (not shown), seat member 6 is lowered by moving it back relative to the base, and the back of the base (or one or more wheel assemblies 9 of the base configuration) is extended. In a different aspect (not shown), the chair may be lowered backwards while the front of the base, extension structure 8, (or one or more wheel assemblies 11 of the base configuration) is extended. In a related aspect (not shown), seat member 6 may be lowered by moving it forward while the back of the base (or one or more wheel assemblies 9 of the base configuration) is extended. As will be apparent, one or multiple parts of the base (or one or more wheel assemblies 9, 11 of the base) may be extended as seat member 6 is adjusted.

Operationally, wheelchair 2 components are able to move relative to one another in order to change the size and shape of the footprint of wheelchair 2, as well as change the height of seat member 6 relative to a surface on which wheelchair 2 is operating. In combination these functions allow an operator to use wheelchair 2 while sitting upright, or while reclining, and to change between these positions.

For explanatory purposes, the fully upright formation of wheelchair 2 (depicted in FIGS. 1, 2, and 4) is referred to as Position A, while the fully reclined formation of wheelchair 2 (depicted in FIGS. 3 and 5) is referred to as Position B. Also for explanatory purposes it is assumed that wheelchair 2 begins in Position A.

In Position A, seat member links 42 are substantially vertical, while seat member links 44 form an acute angle with seat member links 44. Seat member links 50 remain substantially parallel with seat member links 44, forming a four-bar mechanism with seat member sides 36 as the connecting link. A user in wheelchair 2 while it was in Position A would be sitting upright, legs resting within leg rest member 10, bent at the knees, for example, at an angle approximating 90 degrees, such as at an angle within 20 degrees of 90 degrees (e.g. 70, 80, 90, 100 or 110 degrees).

Upon activation of motor 26, motor 26 drives rotation of threaded shaft 20. As threaded shaft 20 rotates, female threaded member 24 is forced along threaded shaft 20, in an axial direction moving away from motor 26. The axial motion of female threaded member 24 drives slide section 16 and extension structure 8 away from main frame 4, increasing the footprint of wheelchair 2 as it does so. Wheel assemblies 11 move with and support extension structure 8 during this transition. Seat member links 42 are pivotally attached a pin block 54 on extension structure 8.

As extension structure 8 moves away from main frame 4, the angle between seat member links 42 and seat member links 44 increases, as does the distance between pin block 8 and main frame 4. This motion draws seat member links 44 and 50 to rotate forward, about fixed pivot points at connecting pins 56. This rotation forces seat member sides 36 forward and down, while remaining substantially horizontal, ensuring that the operator, who is seated on seat member 6 which bridges seat member links 36, will remain safely and comfortably in place while seat member 6 is lowered.

While seat 6 transitions in this manner, leg support assembly 17 extends away from seat member 6 and pivots along with the user's legs at the knee, as the user's legs extend, increasing the angle between the lower leg and upper leg, as that angle approaches 180 degrees. Throughout the transition, swing arm 68, pins 74 and slide blocks 76 maintain support for and control of the user's legs, ensuring that the transition occurs ergonomically, comfortably and safely for the user.

Figure 3:
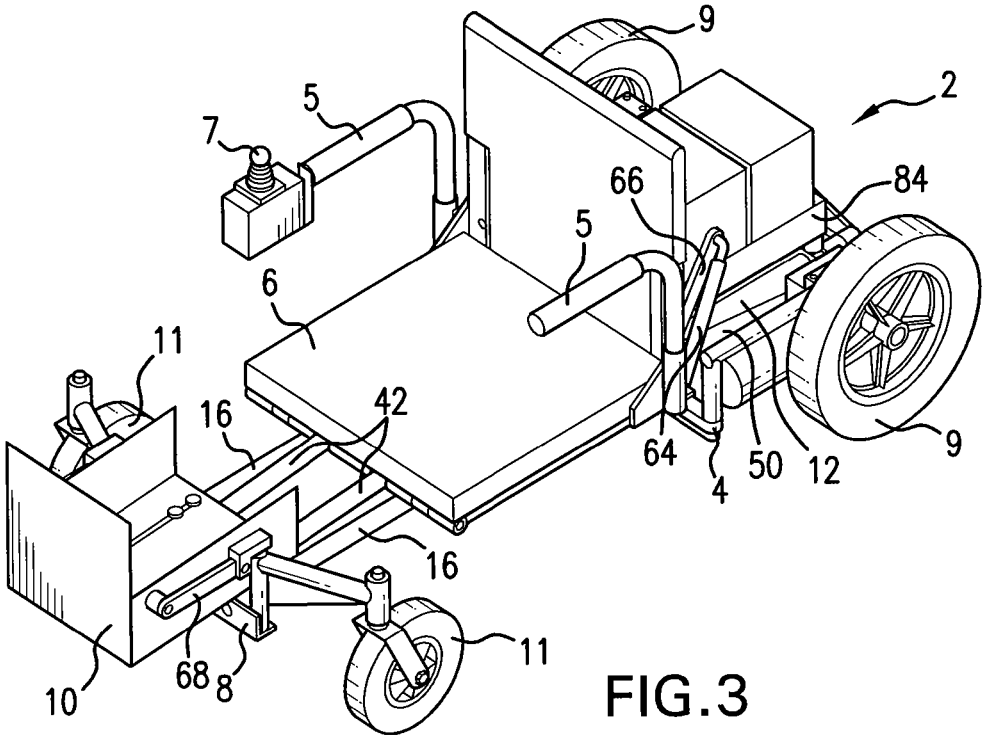
FIG. 3 is a pictorial view of one embodiment of the wheelchair or device of the invention in which the wheelchair is in the lowest position.
Figure 4:
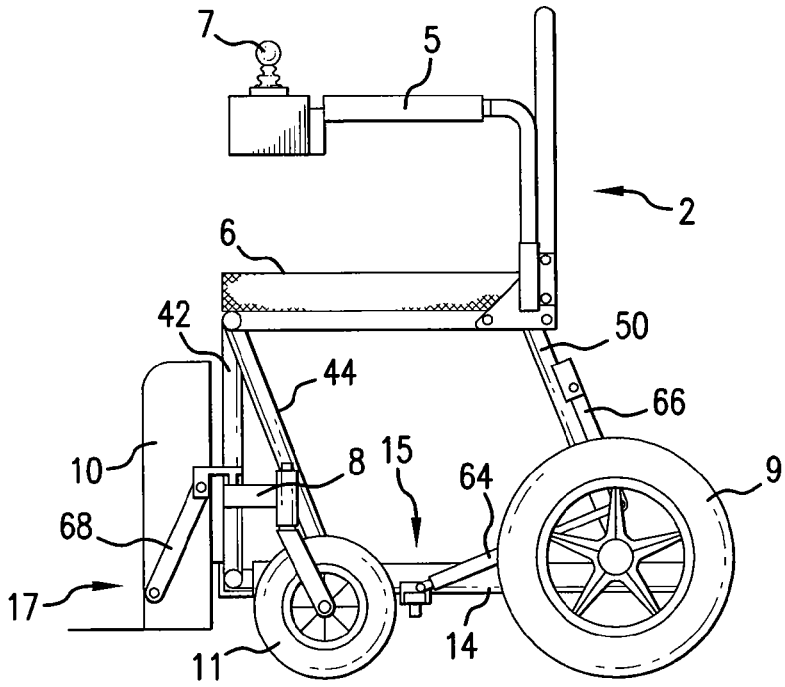
FIG. 4 is a schematic representation of one embodiment of the wheelchair or device of the invention showing the operating mechanisms with the wheelchair in the uppermost position.
Figure 5:
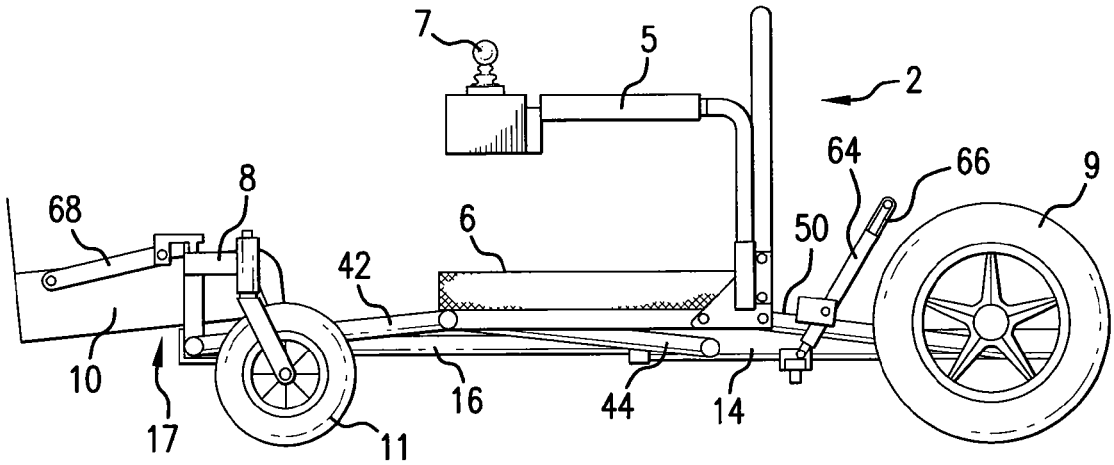
FIG. 5 is a schematic representation of one embodiment of the wheelchair or device of the invention showing the operating mechanisms with the wheelchair in the lowest position.

Once extension structure 8 is fully extended, wheelchair 2 is in Position B, as depicted in FIG. 3. In this position, the front of the device (including the front wheels) is moved forward and the seat is lowered (preferably the seat pivots forward as it is lowered). In a preferred aspect, the distance between the footrest and the seat in the down position is such that the legs of a user will lay flat to provide for better blood circulation. In position B, because leg rest member 10 travels away from main frame 4 with extension structure 8, a user's legs are fully extended, for example, the angle between the upper and lower legs in this position may be substantially 180 degrees, such as within 20 degrees of 170 degrees (e.g. 150, 160, 170 or 180 degrees), and the user is in a seated-reclined position. In position B seat member 6 is at its lowest, and the footprint is at its largest. The two wheel assemblies 11 are fully extended at their farthest distance from the two wheel assemblies 9, resulting in maximum stability. In a preferred aspect, the distance between the footrest and the seat in the down position is such that the legs of a user will lay flat to provide for better blood circulation. In Position B, seat member links 42, 44, and 50 are nearly horizontal, however they retain a sufficient angle from horizontal so as to facilitate the transition from Position B to Position A by way of the driving horizontal force of extension structure 8, to help prevent deflection or binding of the structure. Additionally, gas spring cylinders 64 assist in returning seat member links 42, 44, and 50 to Position A, by introducing a force along the body of seat member links 50. In so doing, gas spring cylinders 64 also decrease the amount of torque that must be supplied by motor 26 in order to initially draw extension structure 8 toward itself.

While in Position B wheelchair 2 of the preferred embodiment is in its most stable position. By rotating seat assembly 13 forward and down, and at the same time extending extension structure 8 forward, the result is to place the center of gravity centrally between wheel assemblies 9 and 11, as well as to lower the center of gravity toward the operating surface or ground.

When it is desired to transition from Position B to Position A, wheelchair 2 is operated such that threaded shaft 20 rotates in the opposite direction as when transitioning from Position A to Position B. This causes female threaded member 24 to travel back along threaded shaft 20 axially toward motor 26, which draws extension structure 8 toward main frame 4, and drives a reversal of the above-described motions of seat member links 42, 44, and 50, so that the angle between seat member links 42 and 44 decreases, and seat member links 44 and 50 rotate backward about connecting pins 56, until all components have returned to the initial state of Position A.

Throughout this cycle, seat member sides 36 remain substantially horizontal, allowing a user to transition from Position A to Position B and back again while remaining seated on seat member 6. Additionally, either transition (from Position A to Position B or from Position B to Position A) can be interrupted at an intermediate position and either reversed or held at that position if the user desires to use wheelchair 2 in such a formation.

Also throughout this cycle, the user is retained within the confines of wheelchair 2 in part by armrests 5 and leg rest member 10. This is particularly important for a user who may have diminished control of his or her body. He or she may desire to change positions for any reason, including comfort, functionality, or for medical reasons, as discussed above. Armrests 5 will help to retain the torso and upper body of the user in place, while leg rest member 10 will help to retain the legs and lower body of the user in place. The particularized guidance that leg rest member 10 provides for the user's legs throughout this cycle is of pivotal importance, as it plays a significant part in the autonomy of the device, and allows the user to control the position of his or her legs through external means by activating the mechanisms of wheelchair 2, when that user may not be able to control the position of his or her legs on his or her own. Because of the potential for injury while moving, leg rest member 10 is shaped such that it will protect the legs, and additionally provides for protection cover 82 to further prevent injury.

Also throughout the cycle, battery or batteries tray 84 and circuit board tray 86 remain in a fixed position relative to main frame 4. This results in increased stability and operative simplicity as opposed to a system where battery or batteries tray 84 and/or circuit board tray 86 would be required to change position in order to accommodate the motion of the mechanisms during a transition.

At Position A or Position B, or any point while fixed or in transition in therebetween, the wheelchair 2 may be operated to travel in either a substantially forward or reverse direction by way of the drive wheels, which are preferably rear wheel assemblies 9. Rear wheel drive provides greater stability and control. Wheelchair 2 may be powered or moved manually by an individual or user or may be motorized by one or more driving motors (not shown). Such motors may be electric and/or combustion motors or combinations thereof. In yet another aspect, any one or a number of wheel assemblies 9, 11 of the device may be powered by such one or more driving motors and preferably the unit of the invention is a multi-wheel drive unit, wherein a number or all of wheel assemblies 9, 11 of the unit are driven by one or more driving motors. Preferably, the device of the invention comprises four (4) wheel assemblies 9, 11 and preferably at least two of such wheel assemblies 9, 11 (and preferably all four) are capable of being driven by one or more driving motors. In another embodiment, one or more motors 26 of the invention are utilized to raise and/or lower all or any part of the unit. In another aspect, one or more motors 26 are utilized to increase and/or decrease the size of the footprint of the unit (or any part of the unit). In another embodiment, the same or different motors may be used to operate all or any number of the functions of the unit, and in a preferred aspect one motor 26 is utilized to move the device, to increase and/or decrease the size of the footprint (or any part of the footprint) and to raise and/or lower all or any part of the unit.

In utilizing wheelchair 2, the different functions of the device may be operated separately or simultaneously depending on the need of the user. When one or more motors provide operation of any or all of the features of the unit, the unit may also comprise one or more control devices 7 allowing the user to control and operate the different features of the invention. For example, one or more control devices 7 may be used to move wheelchair 2, adjust the size of the footprint, and/or adjust the height of the unit and/or adjust the center of gravity.

The present invention provides a number of advantages. In one aspect, the invention prevents the unit from tipping over during use on different types of terrain and in general the invention allows the user to perform a wider range of activities and provides a means by which a user can access a variety of places, some of which may have been previously difficult to reach. The invention also provides more comfort to the user and importantly may address medical concerns for certain individuals by for example allowing better circulation in lower extremities and preventing stiffness. The device decreases the amount of assistance from others that the user will need by allowing the user to autonomously change positions and thus prevent stiffness, and improve circulation, as well as improve the quality of life of the user by allowing him or her to operate more independently.

In accordance with another aspect of the invention, as discussed below with respect to FIGS. 22-31, footrest assembly 210 travels away from both main frame 204 and extension frame 208. This configuration allows for wheelchair 202 to be customized to a user without impairing stability. For example, the size of the footrest assembly 210 and extension mechanism 212 can be adjusted for a taller or shorter user so that a user's legs are fully extended and supported when wheelchair 202 is in fully reclined position without having to make a corresponding adjustment to main frame 204 and/or extension frame 208. Specifically, the extendable length of extension mechanism 212 can be adjusted for the user. In combination or as an alternative, gear mechanism 290 can be customized to a user's size.

As depicted in FIGS. 22-25, wheelchair 202 is basically comprised of a main frame 204, a seat assembly 213, an extension frame 208, a rear wheel assembly 209, a footrest assembly 210 and a front wheel assembly 211.

Figure 23:
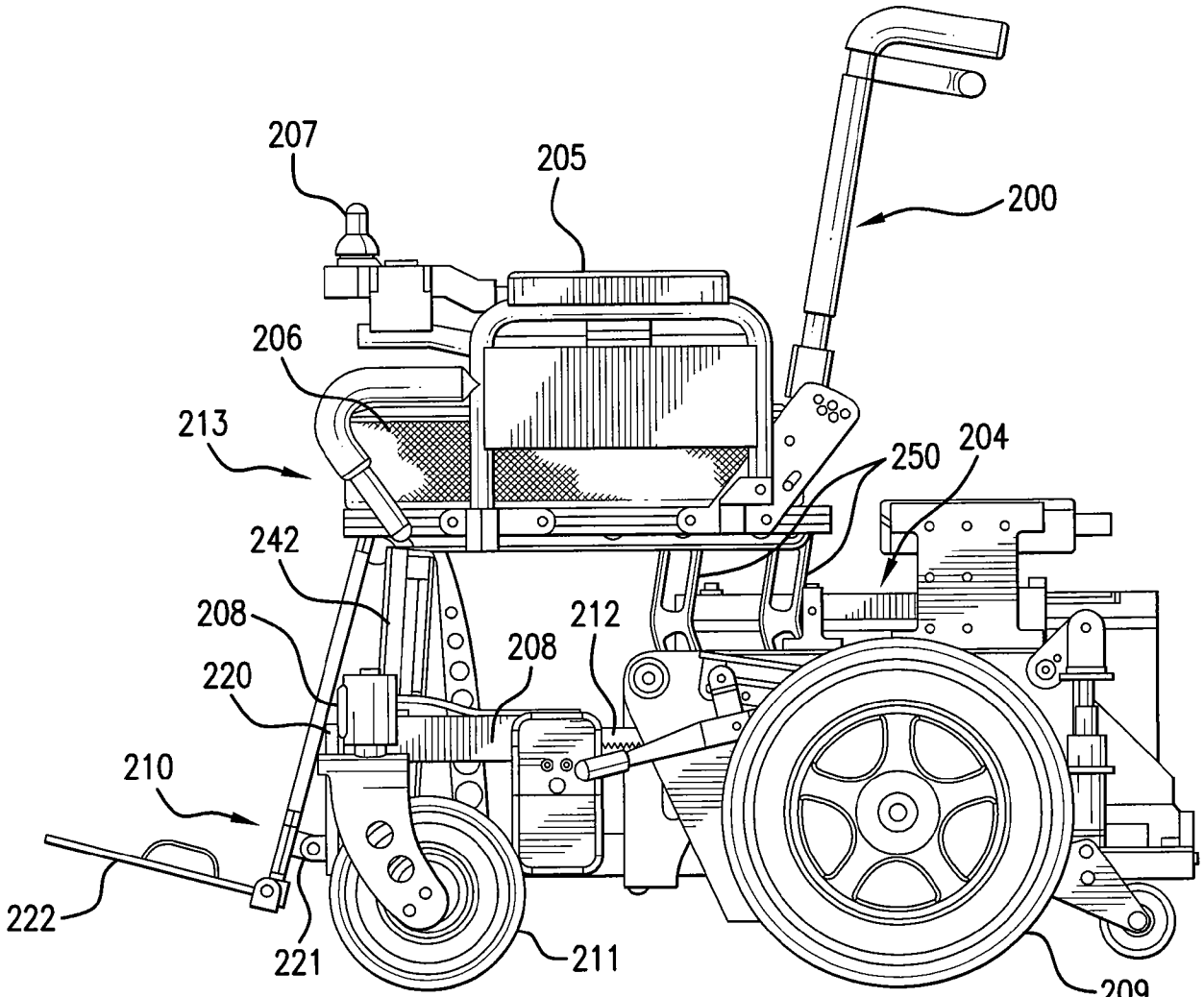
FIG. 23 is a side view of another embodiment of the wheelchair in an upright position, in this embodiment a gear mechanism is used to extend or retract the device.
Figure 25:
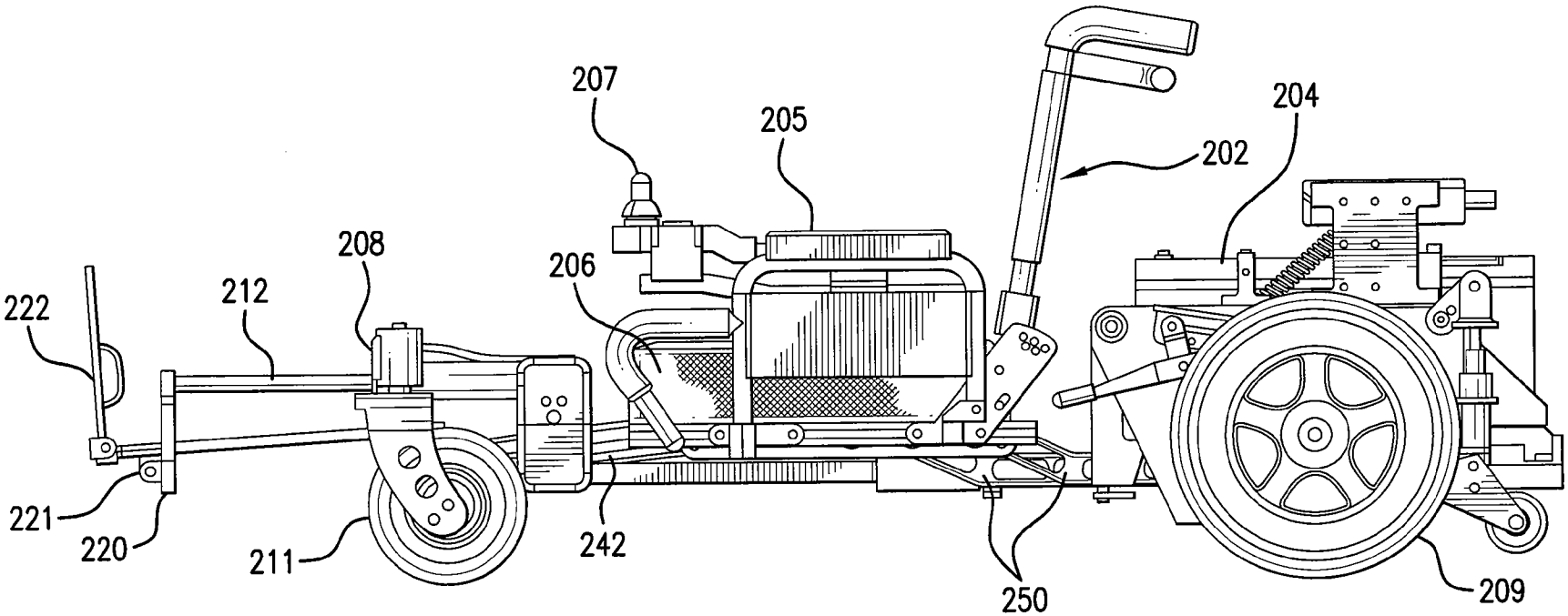
FIG. 25 is a side view of another embodiment of the wheelchair in a lowered position, in this embodiment a gear mechanism is used to extend or retract the device.

In this embodiment, main frame 204 is supported by a pair of rear wheel assemblies 209. Main frame 204 includes seat member links 250 that pivotally connect with seat assembly 213 so as to operably connect main frame 204 and seat assembly 213. Specifically, seat member links 250 are pivotally attached at one end to main frame 204 and pivotally attached at another end to seat assembly 213 at another end. As seen in FIG. 23 and FIG. 25, seat member links 250 are in a substantially vertical position when seat assembly 213 is in an increased height, or fully upright position, and are in a substantially horizontal position when seat assembly 213 is in a decrease height, or fully reclined position.

Seat assembly 213 comprises at least one seat member 206. Seat assembly 213 is pivotally connected to main frame 204 and operably connected to extension frame 208 such that the height of seat assembly 213 may be increased or decreased. Seat assembly 213 is operably connected to extension frame 208 through a seat assembly link 242.

Seat assembly link 242 is pivotally connected to seat assembly 213 at one end and pivotally connected to extension frame 208 at another end. Seat assembly link 242 may further comprise a slot or groove 242*a* that spans the length of seat assembly link 242, to receive a first end of footrest assembly 210. Groove 242*a* provides a track for footrest assembly 210 to slidably move up and down the length of seat assembly link 242 as the height of seat assembly 213 is adjusted.

As seen in FIGS. 22-25, seat assembly link 242 moves between a substantially vertical position and a substantially horizontal position. When seat assembly 213 is in a position of increased height, seat assembly link 242 is in a substantially vertical arrangement. As seat assembly 213 is moved to a decreased height position, seat assembly link 242 moves from a substantially vertical arrangement to a substantially horizontal arrangement and moves extension frame 208 forward away from main frame 204 increasing the footprint of wheelchair 202 and causes footrest assembly to extend away from extension frame 208. When seat assembly 213 height is increased from a decreased height position, seat assembly link 242 moves from a substantially horizontal arrangement back to a substantially vertical arrangement moving extension frame 208 towards main frame 204, decreasing the footprint of wheelchair 202, and causes footrest assembly 210 to move towards extension frame 208.

In FIGS. 22-25, extension frame 208 is supported by two front wheel assemblies 211. However one skilled in the art can appreciate that the invention may utilize any number of wheel assemblies, for example, a single front wheel assembly maybe used. Extension frame 208 is further connected to an extension mechanism 212.

As shown, extension mechanism 212 is slidably connected to extension frame 208. When in a retracted position, extension mechanism 212 is housed in a rear portion of extension frame 208*a*. Extension mechanism 212 passes through openings 208*b* in extension frame 208 and connects to footrest assembly 210. Extension mechanism 212 facilitates movement of footrest assembly 210 away from extension frame 208. In the embodiment shown, extension mechanism 212 consists of a pair of extendable rods. The pair of extendable rods pass through the rear of extension frame 208, out the forward surface 208*c* of extension frame 208 and are attached to footrest assembly 210. As can be appreciated by one skilled in the art, extension mechanism can be one, two, three or any number of extendable rods, or other actuator.

Figure 22:
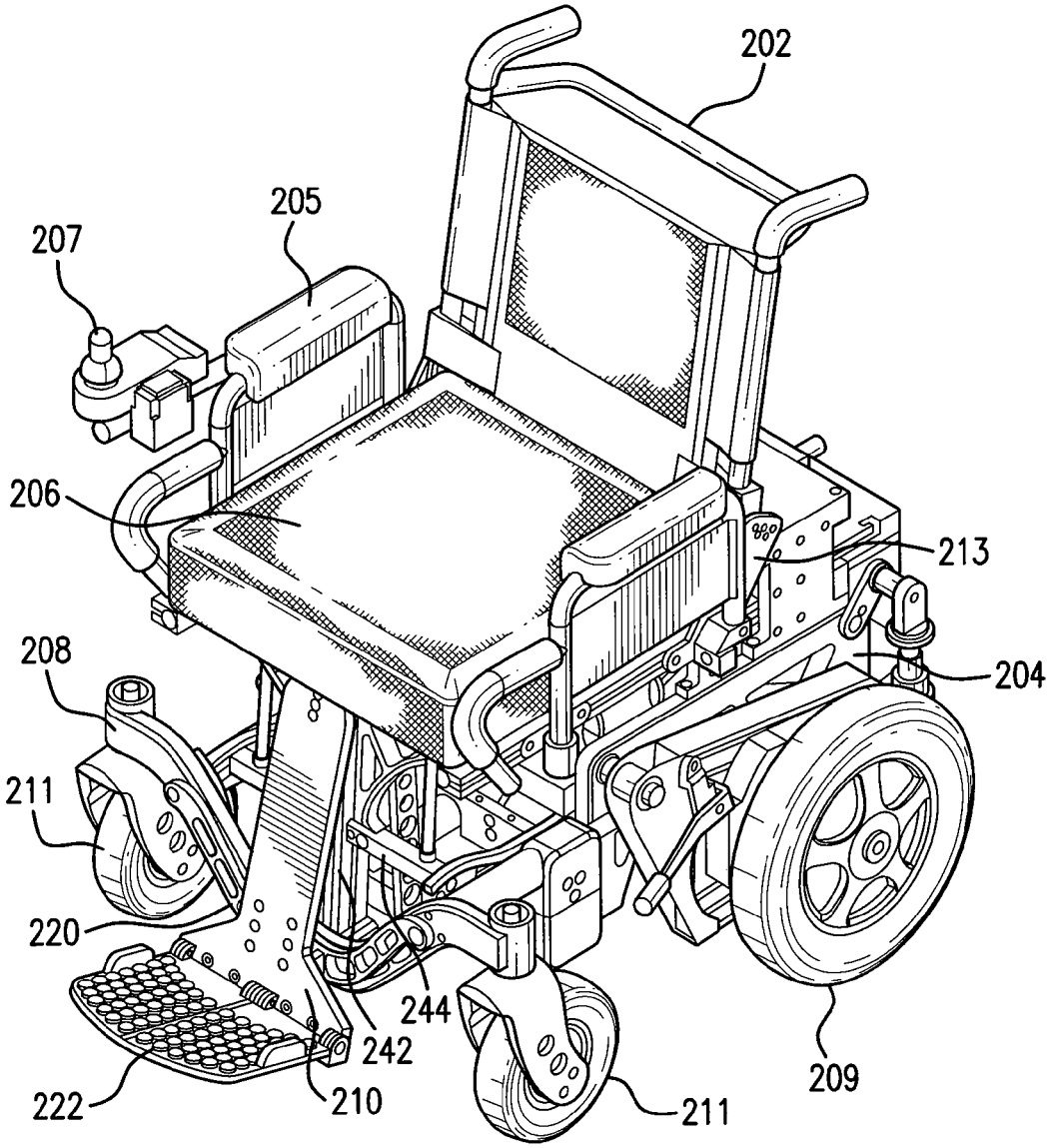
FIG. 22 is a pictorial view of another embodiment of the wheelchair or device of the invention in which the wheelchair is in the uppermost position, in this embodiment a gear mechanism is used to extend or retract the device.

The footrest assembly 210 is slidably attached at one end to seat link assembly 242 and pivotally connected at another end to extension mechanism 212. In the embodiment shown in FIGS. 22-28, footrest assembly comprises a push bar 220, a footrest link member 221, and a footrest member 222. Push bar 220 is disposed on a forward surface 208*b* of extension frame 208 when seat assembly 213 is in a fully upright position, as depicted in FIGS. 22 and 23. Push bar 220 is fixedly attached to an end of each extension mechanism 212 such that operation of extension mechanism 212 causes footrest assembly 210 to extend away or toward extension frame 208. Footrest link member 221 is pivotally connected to push bar 220 and fixedly connected to footrest member 222.

Figure 24:
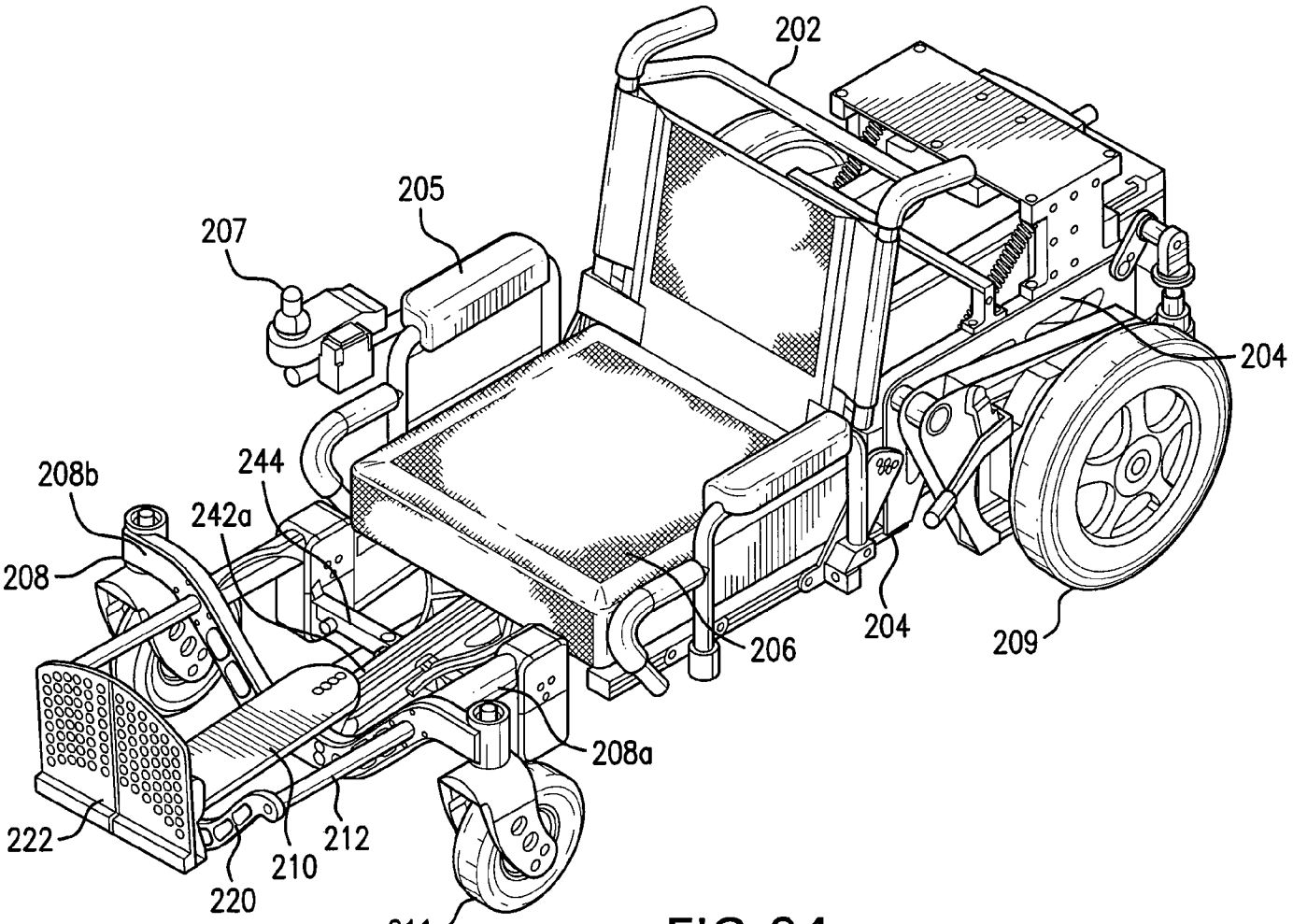
FIG. 24 is a pictorial view of another embodiment of the wheelchair in a lowered position, in this embodiment a gear mechanism is used to extend or retract the device.
Figure 26:
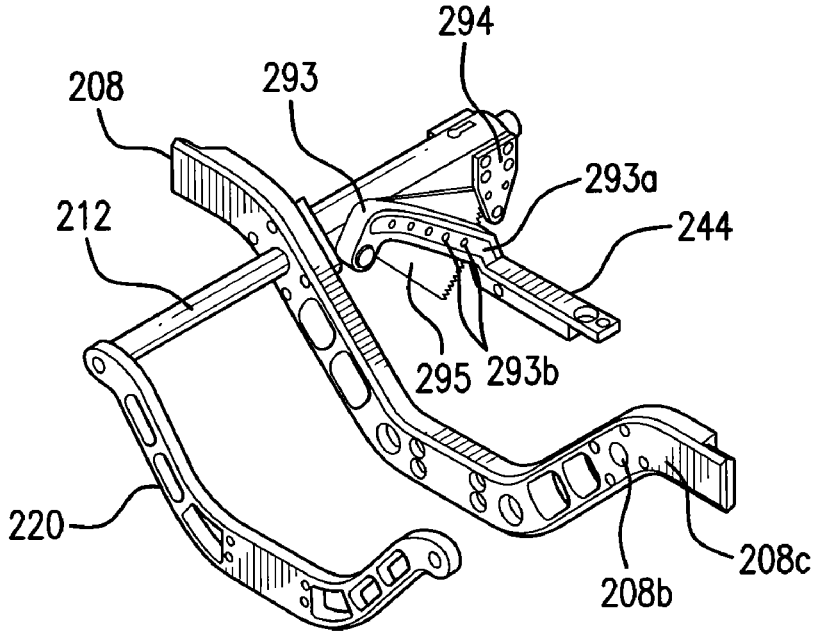
FIG. 26 is a partial section and view of a gear mechanism operably connected to the extension frame and footrest assembly when extended.
Figure 27:
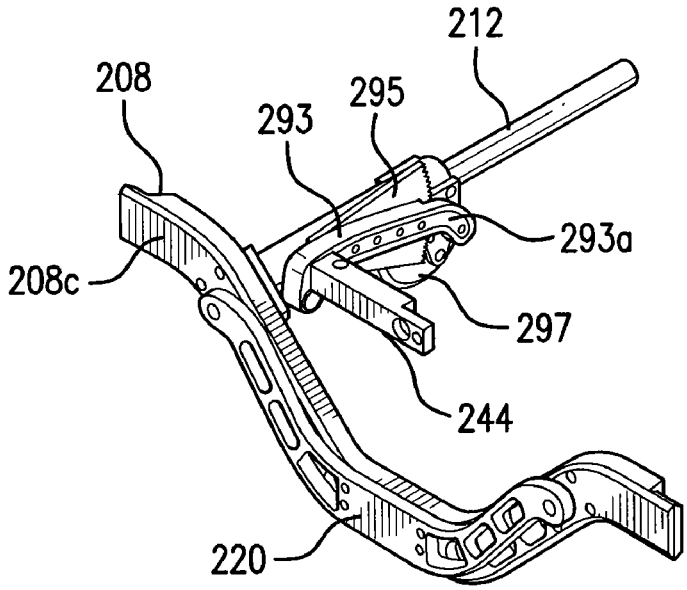
FIG. 27 is a partial section and view of a gear mechanism operably connected to the extension frame and footrest assembly when retracted.

As shown in FIGS. 24-26, footrest assembly 210 can be extended away from extension frame 208. Extension of push bar 220 causes footrest member 222 to slide along the slot or groove 242*a* in seat link member 242 to an extended position. The movement of footrest assembly 210 is controlled by a gear assembly which moves extension mechanism 212. Footrest assembly 210 is moved between a first retracted position, corresponding to a bent-knee seated position of a user, and a second extended position, corresponding to a straight-leg seated position of a user, by actuating gearing mechanism 290.

Gearing mechanism 290 is connected to seat assembly link 242 and extension mechanism 212 to operably connect it to both extension frame 208 and footrest assembly 210. Seat assembly link 242 connects to gearing mechanism 290 via seat assembly link pins 244, which are slidably connected to gear mechanism 290. Gearing mechanism 290 is meshed to extension mechanism 212.

In one embodiment, gearing mechanism 290 includes a spur gear housing 294, connected to extension frame 208, and a segment gear 295. Spur gear housing 294 houses at least a small spur gear 296 attached to a large spur gear 297, which meshes with extension mechanism 212 to extend and retract extension mechanism 212. Extension mechanism 212 has a plurality of grooves or teeth 212*a* for receiving large spur gear 297. Segment gear 295 is operably connected to seat assembly link 242 at one end and meshes with small spur gear 296 at another end. Specifically, seat assembly link pin 244 operably connects seat assembly link 242 to segment gear 295 via segment gear fixture 293. Pin 244 is connected to seat assembly 242 at one end and extends outward to slidably connect to segment gear fixture 293. Segment gear fixture 293 is pivotally attached to extension frame 208 and operably connected to segment gear 295. Segment gear fixture 293 comprises a slot 293*a* with a plurality of positions 293*b* for receiving pin 244. As can be appreciated by one skilled in the art, gear mechanism 290 can include any number of segment gear fixtures, segment gears, spur gear housings, and spur gears. Alternative actuating mechanism can also be used to translate movement of seat assembly link 242 to extension mechanism 212.

In the embodiment shown in FIGS. 22-25, gearing mechanism 290 includes a left and right pair each of segment gear fixtures 293, segment gears 295, spur gear housings 294, small spur gears 296 and large spur gears 297. The left segment gear fixture 293, left segment gear 295, left spur gear housing 294, left small spur gear 296 and left large spur gear 297 are shown in exploded views in FIGS. 26-29, where elements have been removed for ease of view.

Figure 28:
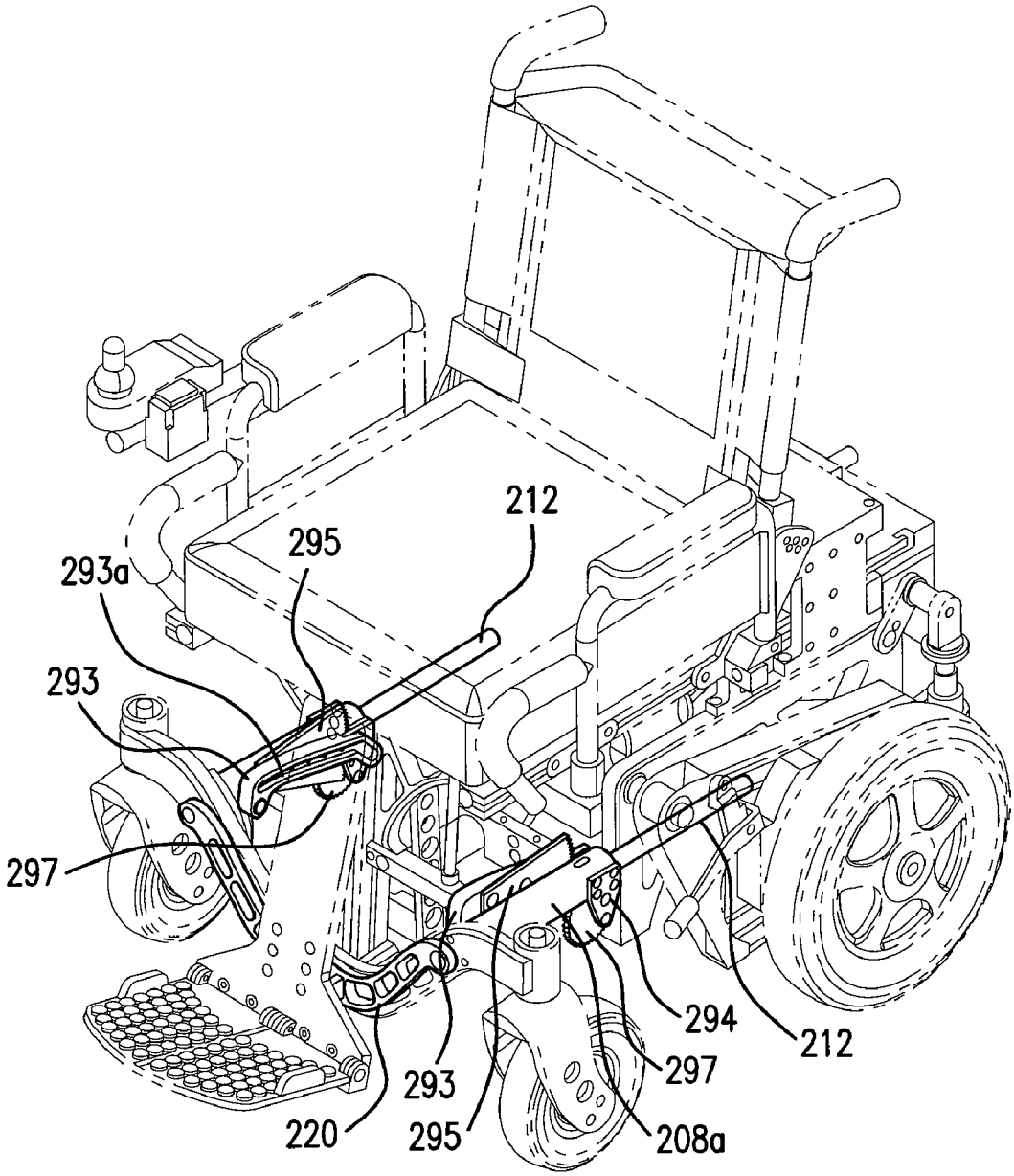
FIG. 28 is a partial section and view of a gear mechanism operably connected to the seat assembly link, extension frame and footrest assembly when retracted, with the wheelchair shown in shadow.
Figure 29:
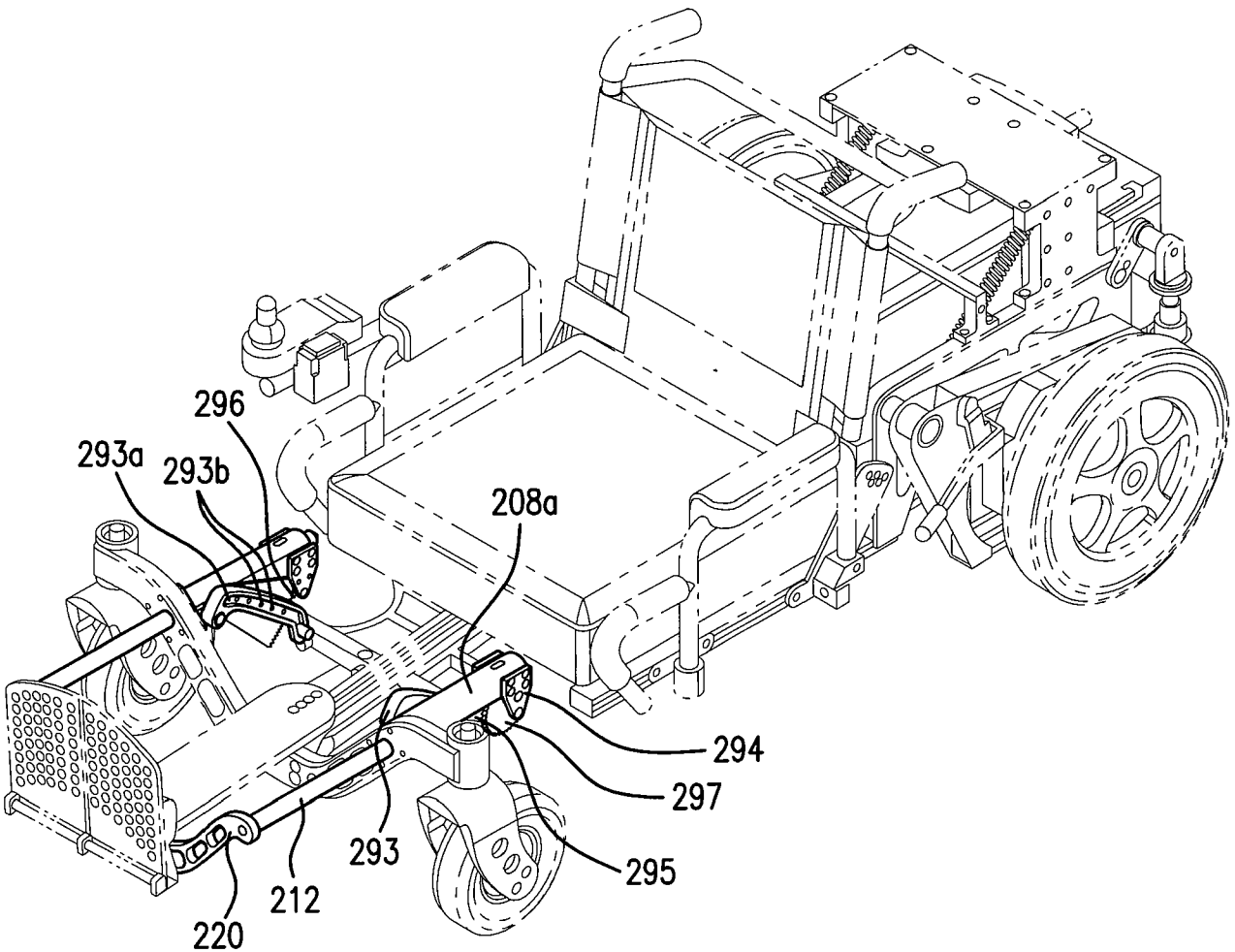
FIG. 29 is a partial section and view of gear mechanism operably connected to the seat assembly link, the extension frame and the footrest assembly when extended, with the wheelchair shown in shadow.

As seen in exploded views FIGS. 28 and 29, gearing mechanism 290 is capable of causing extension mechanism 212 to extend footrest assembly 210 away from extension frame 208 when seat assembly link 242 moves from a substantially vertical arrangement to a substantially horizontal arrangement and is capable of causing extension mechanism 212 to retract footrest assembly 210 toward forward surface 208*b* of extension frame 208 when seat assembly link 242 moves from a substantially horizontal arrangement to a substantially vertical arrangement.

In this embodiment, as seat assembly 213 can be pivoted from a position above main frame 204 to a position forward of main frame 204 such that the height of seat member 206 is decreased. As seat assembly 213 pivots and moves to a decreased height position, seat assembly exerts a downward force on seat assembly link 242 forcing seat assembly link to move from a substantially vertical arrangement to a substantially horizontal arrangement, as extension frame 208 and front wheel assemblies 211 are shifted away from main frame 204.

As seat assembly link moves, seat assembly link pins 242*a* slidably move along slot 293*a* in segment gear fixtures 293. Movement of seat assembly link pins 242*a* in slot 293*a* causes segment gear fixture 293 to move segment gear 295 in a downward direction. As segment gear 295 moves downward, it meshes with small spur gear 296 causing small spur gear 296 to rotate. As small spur gear 296 rotates, so to does large spur gear 297. As large spur gear 297 rotates, it meshes with grooves 212*a* of extension mechanism 212 forcing extension mechanism 212 forward, away from main frame 204, through openings 208*b* in extension frame 208. Extension of extending arms 212 causes push bar 220 to extend away from the extension frame 208. As push bar 220 moves forward, footrest member 222 slidably travels down groove 242*a* in seat assembly link 242 and pivots at footrest link 221 so that footrest member 222 moves to a substantially horizontal position that fully supports the legs of the user's in an extend straight leg position.

When a user desires to return to a substantially upright position with bent-knees, footrest member 222 can be retracted and moved back toward extension frame 208. As seat assembly 213 moves from a reclined position to an upright position, seat assembly link 242 moves from a substantially horizontal position to a substantially vertical position. Movement of seat assembly link 242 cause pins 244 to move in the reverse direction along slot 293*a* in segment gear fixtures 293 forcing segment gear 295 upward. As segment gear 295 moves upward, it meshes with small spur gear 296 causing small spur gear 296 and large spur gear 297 to rotate in an opposite direction. Large spur gear 297 causing large spur gear 297 meshes with grooves 212*a* of extension mechanism 212 and extension mechanism 212 is retracted, causing push bar 220 to move towards extension frame 208. As push bar 220 moves, footrest member 222 slidably travels up groove 242*a* in seat assembly link 242 and pivots at footrest link 221 to return to a substantially vertical arrangement.

The extendable length of the extension rods and the diameter of the small spur gear 296 can be correctly sized to provide custom fit for the individual user. In one embodiment, these elements can be adjusted to a movement from 0-20 inches and preferably from 0-15 and more preferably from 0-10 inches. As such, the wheelchair or device can be customized for a wide range of user heights, allowing the rider's legs to be fully extended and supported by footrest assembly 210 when the chair is in the down or reclined position. Further, front wheel assemblies 211 can remain in a stable position under the wheelchair providing a common footprint, despite the increased extension of footrest assembly 210, resulting in increased stability.

Wheelchair 202 may further be provided with a spring assist to return seat assembly 213 to a position of increase height from a position of decreased height. Spring assist will be described with reference to partial views, FIGS. 30 and 31.

Figure 30:
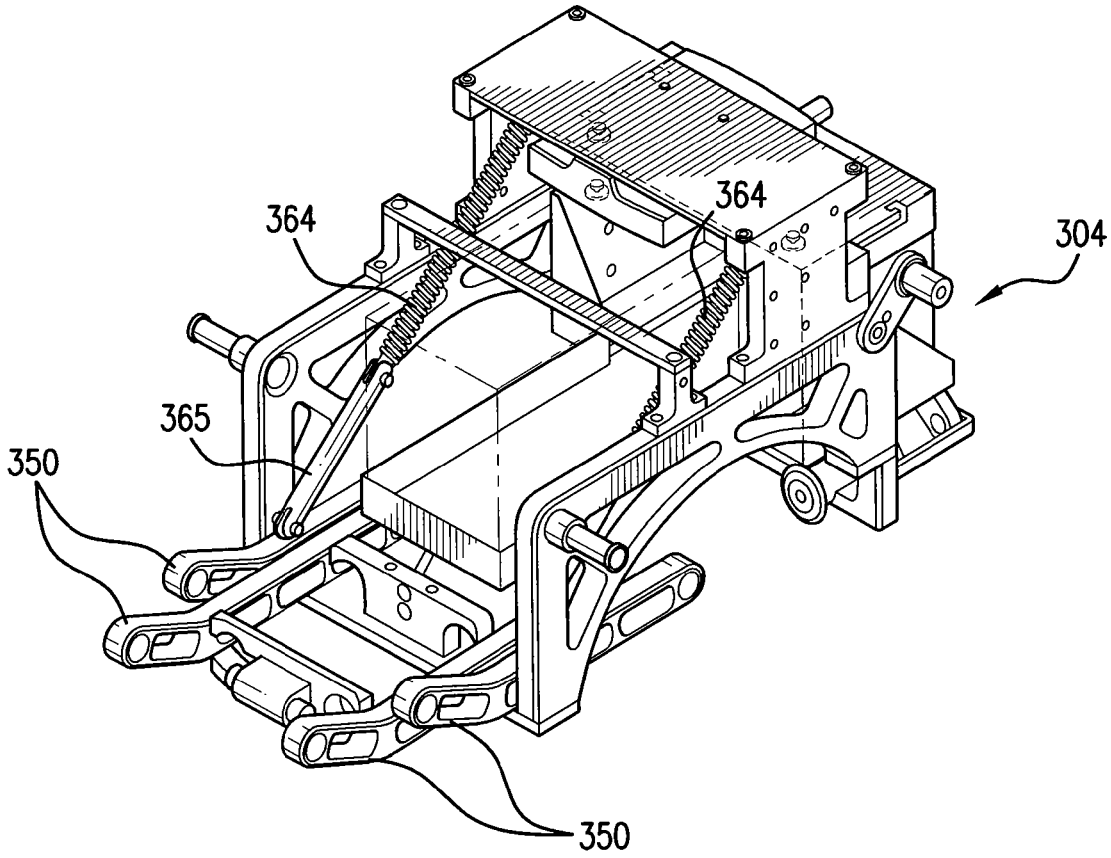
FIG. 30 is a partial section and view of a spring assist mechanism when extended.
Figure 31:
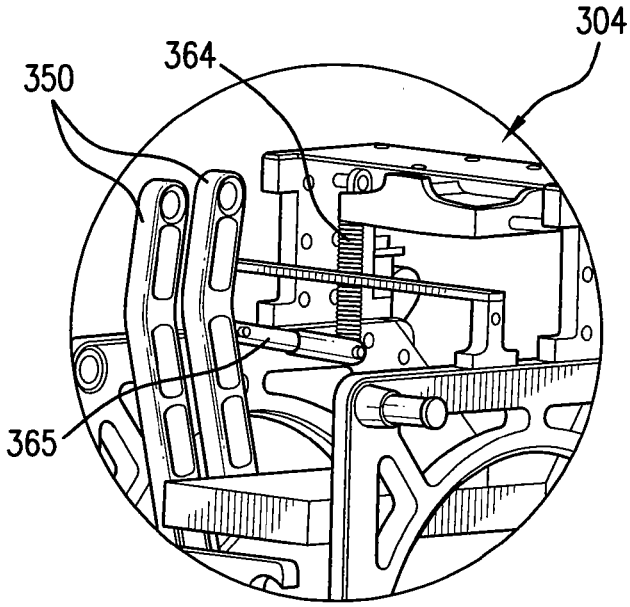
FIG. 31 is a partial section and exploded view of a spring assist mechanism when retracted.

As shown in FIGS. 30 and 31, a spring assist mechanism can be incorporated in main frame 304. In this configuration main frame 304 includes seat member links 350, spring 364 and spring link 365. Main frame 304 is supported by rear wheel assemblies 309 (not shown) and is pivotally connected to seat assembly 313 (not shown) via seat member links 350.

Seat member links 350 are pivotally connected to main frame 304 at one end and pivotally connected to seat assembly 313 at another end. Seat member links 350 are in a substantially vertical arrangement when seat assembly 313 is in a position of increased height and are capable of pivoting to a substantially horizontal arrangement, when seat assembly 313 moves to a position of decreased height. Seat member links are further operably connected to springs 364 via spring links 365. Spring links 365 are pivotally connected to springs 364 at one end and pivotally connected to seat member links 350 at another end. As seat member links 350 pivotally move from a substantially vertical arrangement to a substantially horizontal arrangement, spring links 365 extend causing springs 364 to be pulled into a loaded position. When a user desires to return seat assembly to raised position, springs 364 unload and assist with raising seat assembly 313 to a position of increased height.

Figure 32:
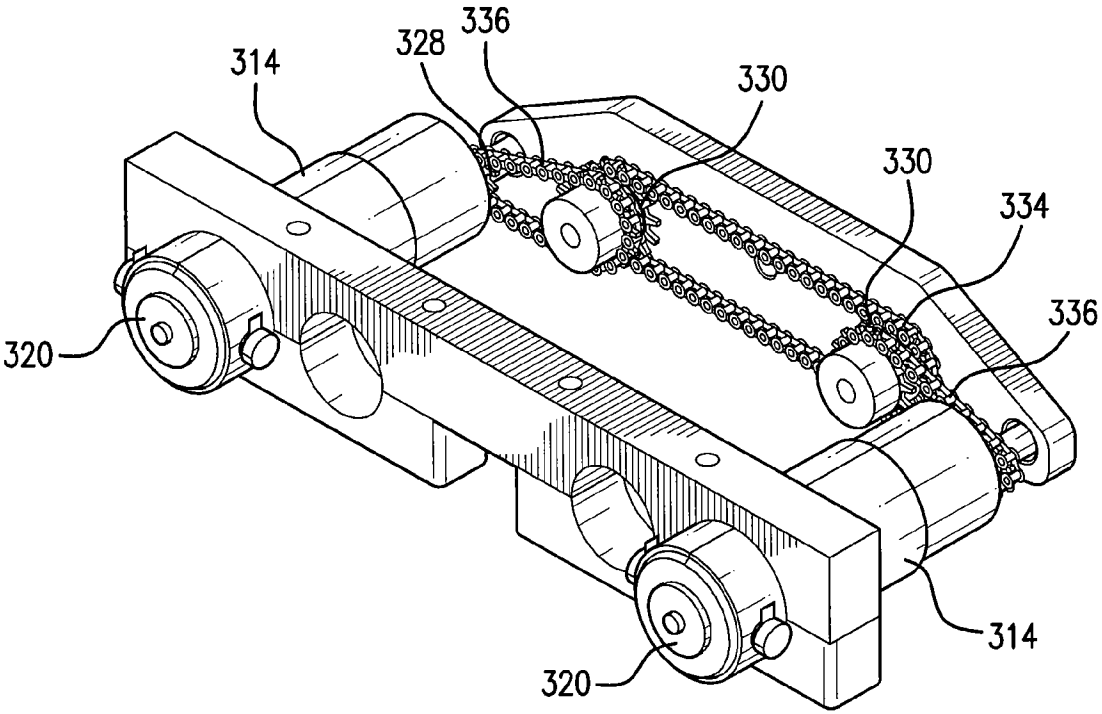
FIG. 32 is a partial section and view of a dual chain drive mechanism.
Figure 30:
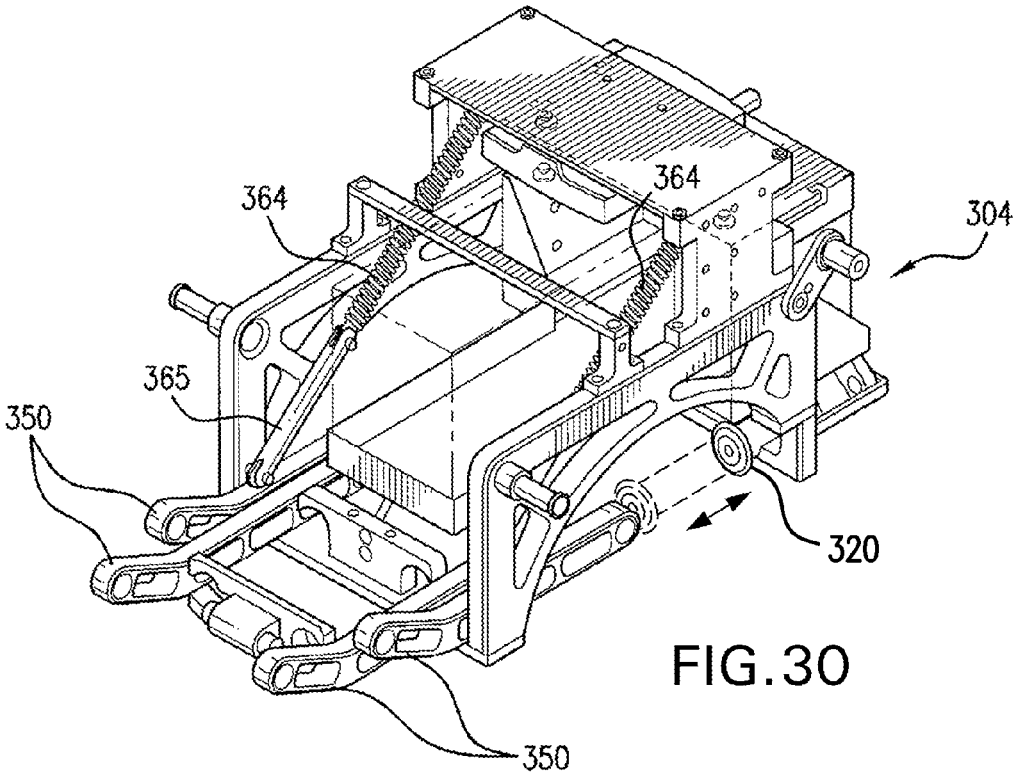
Figure 31:
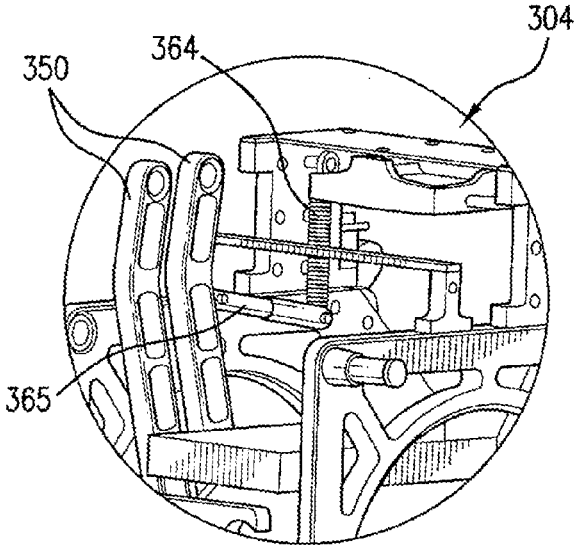

In another embodiment, movement of seat assembly 213 can be further assisted by using a dual chain drive mechanism as shown in FIG. 32. Upon activation of at least one motor (not shown) main chain 334 meshes with gears 330. Gears 330 mesh with secondary chains 336, which mesh with gears 328 and drive shaft 320 to extend. Extension of 320 causes seat link members 350 to pivot and move seat assembly 213 (not shown) between an increased height position and a decreased height position and move extension frame 208 between an extended position and a retracted position. This embodiment doubles the torque transmitted to gears 328 and increases the left capacity of wheelchair 202.

In alternative embodiments, wheelchair 202 may be provided with a lever or other mechanism to assist with initiating movement of seat assembly 213. Additionally, a brake or other locking mechanism can be provided to hold seat assembly 213, extension frame 208 and footrest assembly 210 in a position desired by the user.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A wheelchair comprising:

a main frame;

a seat assembly pivotally connected to said main frame, such that the height of said seat assembly may be increased or decreased;

a seat assembly link pivotally connected at a first end to said seat assembly, wherein said seat assembly link is capable of moving from a substantially vertical arrangement to a substantially horizontal arrangement when said height of said seat assembly is decreased and wherein said seat assembly link is capable of moving from a substantially horizontal arrangement to a substantially vertical arrangement when said height of said seat assembly is increased;

an extension frame pivotally connected at a second end of said seat assembly link, wherein said extension frame has a forward surface;

an extension mechanism connected to said extension frame;

a footrest assembly slidably connected at a first end to said seat assembly link and pivotally connected at a second end to said extension mechanism, and a gearing mechanism operably connected to said extension mechanism and said seat assembly link, wherein said gearing mechanism is capable of causing said extension mechanism to extend said footrest assembly away from said forward surface of said extension frame when said seat assembly link moves from a substantially vertical arrangement to a substantially horizontal arrangement and wherein said gearing mechanism is capable of causing said extension mechanism to retract said footrest assembly toward said forward surface of said extension frame when said seat assembly link moves from a substantially horizontal arrangement to a substantially vertical arrangement.

2. The wheelchair of claim 1, further comprising a plurality of wheels, wherein at least one of said wheels is disposed on said extension frame.

3. The wheelchair of claim 1, further comprising a push bar fixed to an end of said extension mechanism and pivotally connected to said footrest assembly, such that said extension mechanism is capable of causing said push bar to extend away from said extension frame when said height of said seat member is decreased and said extension mechanism is capable of causing said push bar to retract toward said extension frame when said height of said seat member is increased.

4. The wheelchair of claim 3, further comprising a footrest link, wherein said footrest link is pivotally connected to said push bar and fixedly attached to said footrest assembly.

5. The wheelchair of claim 1, wherein pivoting said seat assembly to a decreased height position activates said gearing mechanism to cause said extension mechanism to move said footrest assembly away from said extension frame.

6. The wheelchair of claim 1, wherein pivoting said seat assembly to an increased height position activates said gearing mechanism to cause said extension mechanism to move said footrest assembly toward said extension frame.

7. The wheelchair of claim 1, further comprising a slot along at least a portion of the length of said seat assembly link, wherein said first end of said footrest assembly is slidably received in said slot.

8. The wheelchair of claim 1, wherein said footrest assembly is capable of supporting a rider's legs in a fully extended position when said seat assembly is in a decreased height configuration.

9. The wheelchair of claim 1, wherein said footrest assembly is capable of supporting a rider's legs in a bent leg position when said seat assembly is in an increased height configuration.

10. The wheelchair of claim 1, wherein said gearing mechanism comprises:

at least one spur gear housing connected to said extension frame, wherein said spur gear housing houses a small spur gear attached to a large spur gear and wherein said large spur gear meshes with said extension mechanism to extend and retract said extension mechanism; and at least one segment gear connected to said seat assembly link, wherein said segment gear meshes with said small spur gear.

11. The wheelchair of claim 10, further comprising:

at least one pin fixed at a first end to said seat assembly link and operably connected at a second end to said at least one segment gear.

12. The wheelchair of claim 11, further comprising at least one segment gear fixture pivotally attached to said extension frame and operably connected to said at least one segment gear, wherein said segment gear fixture comprises a slot;

wherein said second end of said at least one pin is received in said slot of said segment gear fixture, such that said pin is capable of moving along said slot in said segment gear fixture to transfer motion of said seat assembly link to said segment gear.

13. The wheelchair of claim 12, wherein said pin is capable of moving along said slot in said segment gear fixture to cause said segment gear to move in a downward direction engaging said small spur gear, which causes said large spur gear to engage with said extension mechanism and extend said extension mechanism away from said forward surface of said extension frame.

14. The wheelchair of claim 10, wherein the diameter of said small spur gear can be adjusted to provide a custom fit for the rider of said wheelchair.

15. The wheelchair of claim 1, wherein the extendable length of said extension mechanism can be adjusted to provide a custom fit for the rider of said wheelchair.

16. A wheelchair comprising:

a main frame;

a seat assembly pivotally connected to said main frame, such that the height of said seat assembly may be increased or decreased;

a seat assembly link pivotally connected at a first end to said seat assembly, wherein said seat assembly link is capable of moving from a substantially vertical arrangement to a substantially horizontal arrangement when said height of said seat assembly is decreased and wherein said seat assembly link is capable of moving from a substantially horizontal arrangement to a substantially vertical arrangement when said height of said seat assembly is increased;

an extension frame pivotally connected at a second end of said seat assembly link, wherein said extension frame has a forward surface;

a pair of extension mechanisms connected to said extension frame;

a push bar fixed to an end of each of said extension mechanisms;

a footrest assembly slidably attached at a first end to said seat assembly link and pivotally connected at a second end to said push bar, and a gearing mechanism operably connected to said extension mechanism and said seat assembly link, wherein said gearing mechanism is capable of causing said extension mechanisms to extend said push bar and said footrest assembly away from said forward surface of said extension frame when said seat assembly link moves from a substantially vertical arrangement to a substantially horizontal arrangement and wherein said gearing mechanism is capable of causing said extension mechanisms to retract said push bar and said footrest assembly toward said forward surface of said extension frame when said seat assembly link moves from a substantially horizontal arrangement to a substantially vertical arrangement.

* * * * *